US006955012B2

(12) United States Patent
Suzuki

(10) Patent No.: US 6,955,012 B2
(45) Date of Patent: Oct. 18, 2005

(54) ROOF AND ROOF BOARD MATERIAL

(75) Inventor: Motoyuki Suzuki, Nagoya (JP)

(73) Assignee: Kabushiki Kaisha Muzukuwa, Nagoya (JP)

( * ) Notice: Subject to any disclaimer, the term of this patent is extended or adjusted under 35 U.S.C. 154(b) by 214 days.

(21) Appl. No.: 10/149,477

(22) PCT Filed: Dec. 14, 2000

(86) PCT No.: PCT/JP00/08882

§ 371 (c)(1),
(2), (4) Date: Sep. 17, 2002

(87) PCT Pub. No.: WO01/44598

PCT Pub. Date: Jun. 21, 2001

(65) Prior Publication Data

US 2003/0051419 A1 Mar. 20, 2003

(30) Foreign Application Priority Data

Dec. 15, 1999 (JP) ..... 11-356175
Sep. 20, 2000 (JP) ..... 2000-284586
Dec. 8, 2000 (JP) ..... 2000-374046
Dec. 8, 2000 (JP) ..... 2000-374055

(51) Int. Cl.[7] ..... F24F 7/02
(52) U.S. Cl. ..... 52/198; 52/199; 52/545; 52/95; 52/529
(58) Field of Search ..... 52/302.1, 588.1, 52/198, 199, 95, 90.1, 518, 409, 468, 545, 52/586.1, 529, 530, 531, 542

(56) References Cited

U.S. PATENT DOCUMENTS 3,422,721 A * 1/1969 Yonkers ..... 411/369
4,924,761 A * 5/1990 MacLeod et al. ..... 454/365
5,326,318 A * 7/1994 Rotter ..... 454/365
5,737,891 A * 4/1998 Greenberg ..... 52/469
6,293,744 B1 * 9/2001 Hempfling et al. ..... 411/372.5
6,308,472 B1 * 10/2001 Coulton et al. ..... 52/198
6,599,184 B2 * 7/2003 Morris ..... 454/365

FOREIGN PATENT DOCUMENTS

JP 56-31132 8/1954

(Continued)

*Primary Examiner*—Brian E. Glessner
*Assistant Examiner*—Basil Katcheves
(74) *Attorney, Agent, or Firm*—Beyer Weaver & Thomas LLP

(57) ABSTRACT

The structure of the present invention simplifies a roofing procedure at the ridge of a roof, ensures easy detachment and relocation, and enables ventilation of the air via the ridge.

Each roof plate 10 has a third projection board 43 and a second projection board 42 protruded from the upper face of a roof plate member 12. The roof plates 10 fixed to roof rafters N are covered with a ridge capping 120 at the ridge of the roof. The ridge capping 120 has skirt elements 123 and rear projection plates 125 protruded from its lower face to be fitted in the recess defined by each pair of joint members 14L of the adjoining roof plates 10. In the area covered by the ridge capping 120, the skirt elements 123 protruded from the lower face of the ridge capping 120, the third projection boards 43 protruded from the upper face of the roof plate members 12, and the rear projection plates 125 protruded from the lower face of the ridge capping 120 are arranged to face each other in this sequence from the pole plate side to the ridge side to form horizontal arrays along the pitch of the roof.

27 Claims, 24 Drawing Sheets

FOREIGN PATENT DOCUMENTS

| | | |
|---|---|---|
| JP | 59-126025 | 8/1984 |
| JP | 61-95836 | 6/1986 |
| JP | 61-108706 | 7/1986 |
| JP | 4-92930 | 8/1992 |
| JP | 05-010000 | 1/1993 |
| JP | 7-12510 | 3/1995 |
| JP | 08-086057 | 4/1996 |
| JP | 08-120977 | 5/1996 |
| JP | 08-177187 | 7/1996 |
| JP | 09-032208 | 2/1997 |
| JP | 09-273270 | 10/1997 |
| JP | 10-227088 | 8/1998 |

* cited by examiner

ENLARGED SECTIONAL VIEW,
TAKEN ON LINE V-V

ROOF AND ROOF BOARD MATERIAL

TECHNICAL FIELD

The present invention relates to a roof shingled by laying roof plates with a certain pitch of roof from the ridge or the roof peak to the pole plates on both sides, as well as to a roof plate that ensures roofing of excellent durability, heat resistance, and noise reduction by a simple procedure and allows relocation via attachment and detachment.

BACKGROUND ART

Tiles have conventionally been used for roofing. The recent trend, however, uses metal roof plates in place of the tiles. The roof plates made of metal have excellent durability.

The rainfall measure is required at the ridge of the roof when the roof plates are laid on both sides of the ridge with a pitch of roof to shingle the roof. In the case of tile roofing, for the rainfall measure, ridge tiles, such as plain tiles, specific tiles, and ornamental tiles, are bound to the foundation with linear elements and fixed with lime plaster. In the case of roofing with metal plates, on the other hand, the roof plates on both roof planes are covered with a ridge capping, which is curved along the pitch of the roof, across the roof width.

For coverage with the ridge capping, copings are laid over the roof plates on both roof planes across the roof width and are fixed to roof frame members (for example, sheathing roof boards and roof rafters) with screws and nails. The screws and nails penetrate the roof plates under the copings to reach the foundation. The ridge capping is then fixed to the copings with screws and nails.

The prior art ridge capping requires a large number of nails and screws for fixation, which is time and labor consuming. In the case of detachment of the existing ridge capping and roof plates for recycle, all the hammered screws and nails should be removed. This is also troublesome. The nails form through holes in the roof plate, which causes the following problem.

If rainwater enters the gap between the ridge capping and the roof plate, the penetrating water may cause rust around the through hole and damage the roof plate. For the effective rainfall measure, the ridge capping should be processed in the field of roofing according to the roof plates laid on the roof. Such processing is rather time and labor consuming.

For the improved residential environment, ventilation of the air inside the building and under the roof has highly been demanded. The ridge at the peak of the roof is adequate for ventilation of the air. The ridge capping is, however, not usable for ventilation of the air, because of the rainfall measure. The popular means for ventilation is accordingly a ventilation fan attached to the wall of the building.

The roof plate made of a metal of excellent durability has a drain board below the joint with an adjoining roof plate. The drain board functions to prevent penetration of rainwater from the joint. The structure of keeping the roof frame member (the sheathing roof board or the roof rafter) from rainwater, in combination with the excellent durability of the roof plate, effectively protects the roof.

The prior art roof plates, however, have several problems to be solved, and can not sufficiently replace the tiles.

The first problem arises in the firm and close joint of the adjoining roof plates to prevent penetration of rainwater. Even the extremely firm and close joint, however, can not perfectly prevent invasion of water, which is a fluid of large surface tension. There is accordingly a certain limit in the effect of keeping the roof frame member (the sheathing roof board or the roof rafter) from rainwater.

The second problem is metal-pattering sound of raindrops, when a metal of excellent durability is applied for the material of the roof plate. The pattering sound is transmitted through the roof frame member (the sheathing roof board or the roof rafter) that is directly in contact with the roof plate and affects an attic or a loft.

The third problems is a significant temperature change of the metal roof plate with the varying environment, since the metal roof plates have extremely low specific heat, compared with the ceramic tiles. The temperature change is transmitted through the wooden roof frame member (the sheathing roof board or the roof rafter). The transmitted temperature change, in combination with the penetrating rainwater, undesirably shortens the serviceable life of the roof. Application and release of heat over the whole roof plane shingled with the roof plates makes the inside of the building hot in summer and cold in winter.

Other drawbacks are also noted.

The roofing with tiles only requires the tiles to be mounted on batten seams fixed to the sheathing roof boards. The roofing with roof plates, on the other hand, requires clips of a specific shape and bending of the roof plates according to the specific shape of the clips. Otherwise the roof plates should be fixed to the roof frame members (the sheathing roof boards or the roof rafters) with screws and nails for roofing.

In the former structure, the clips should be fixed for joint with the bended portion of the roof plates and a relatively large number of clips are required. This makes the roofing procedure rather time and labor consuming. In the case of detachment of the roof plates, the joint with the clips should be released. The roof plate itself, however, hides its joint. The procedure of releasing the joint and detaching the roof plates is also time and labor consuming. In the latter structure, on the other hand, the screws and nails should be hammered down to fix the roof plate to the roof rafter. This work also takes time and labor. In the case of detachment of the roof plates, all the hammered nails and screws should be removed. This work is troublesome.

The object of the present invention is thus to solve the problems discussed above and to provide a structure that simplifies a roofing procedure at the ridge of a roof, ensures easy detachment and relocation, and enables ventilation of the air via the ridge.

The object of the present invention is also to provide a roof plate that has excellent durability, effectively prevents penetration of rainwater, and exerts heat insulating and sound isolating effects.

The object of the present invention is further to provide a roof plate that ensures a simplified roofing procedure and easy detachment and relocation.

DISCLOSURE OF THE INVENTION

In order to attain at least part of the above and the other related objects, the present invention is directed to a roof shingled by laying roof plates with a certain pitch of roof from a ridge at a roof peak to pole plates on both sides. The roof includes: multiple convexes that are protruded upward from each of the roof plates and are arranged along a roof width, each of the convexes having a predetermined length from the ridge along the pitch of roof; a ridge capping that is located at the ridge and covers the roof plates on both sides of the roof and the multiple convexes across the roof width to determine a ridge appearance of the roof; and a capping fixation member that fixes the ridge capping to a ridgepole of the roof, such that the ridge capping covers the roof plates and the multiple convexes. The ridge capping has an inter-convex projection plate, which is protruded from a lower face of the ridge capping to be fitted in a recess defined by each adjoining pair of the convexes. The roof plate has a roof plate-side projection board, which is protruded from an upper face of the roof plate and is located above the inter-convex projection plate of the ridge capping along the pitch of roof to face the inter-convex projection plate. The inter-convex projection plate and the roof plate-side projection board have a shape fitting the recess defined by each adjoining pair of the convexes.

In accordance with one preferable application, the ridge capping has a plurality of the inter-convex projection plates along the pitch of roof, and the roof plate-side projection board of the roof plate is located between an adjoining pair of the inter-convex projection plates along the pitch of roof.

In the roof of the present invention, the roof plates on both sides of the roof and the convexes protruded from the upper face thereof are covered along the roof width with the ridge capping that defines the ridge appearance of the roof. The ridge capping is fixed to the ridgepole of the roof by means of the capping fixation member. As the ridge capping covers the roof plates and their convexes, in the space between the ridge capping and the roof plates, the inter-convex projection plate protruded from the lower face of the ridge capping is fitted in the recess defined by each adjoining pair of the convexes on the upper face of each roof plate.

In the space between the lower face of the ridge capping and the upper face of the roof plate, the roof plate-side projection board protruded from the upper face of the roof plate is located upstream the inter-convex projection plate along the pitch of the roof, in the recess defined by the adjoining pair of the convexes. Namely in the space between the lower face of the ridge capping and the upper face of the roof plate, the inter-convex projection plate on the lower face of the ridge capping and the roof plate-side projection board on the upper face of the roof plate are arranged to face each other in this sequence from the pole plate side to the ridge side along the pitch of the roof. In the preferable structure where the ridge capping has a plurality of the inter-convex projection plates along the pitch of the roof, in the space between the lower face of the ridge capping and the upper face of the roof plate, the plurality of the inter-convex projection plates on the lower face of the ridge capping are fitted in the recess defined by the adjoining convexes and are arranged to face each other along the pitch of the roof. The roof plate-side projection board protruded from the upper face of the roof plate is located between the inter-convex projection plates on the lower face of the ridge capping in the recess defined by the adjoining convexes. The inter-convex projection plates on the lower face of the ridge capping and the roof plate-side projection board on the upper face of the roof plate have the above positional relation in the recess of the adjoining convexes on the upper face of the roof plate and effectively prevent penetration of rainwater as discussed below.

The rainwater falling down on the roof hits against the upper face of the ridge capping and is flown down to reach the roof plates and the convexes in a non-covered area without the ridge capping. The flown-down rainwater runs together with rainwater directly falling down on the roof plates and the convexes along the pitch of the roof towards the pole plates. The substantially straight rainfall does not run up toward the ridge against the pitch of the roof. The roof of the present invention thus ensures the effective measure against such rainfall.

The rainfall with gale as in the case of a typhoon, on the other hand, may run up toward the ridge against the pitch of the roof. The upward flow of the rainwater is blocked by the inter-convex projection plates on the lower face of the ridge capping and the roof plate-side projection board on the upper face of the roof plate arranged along the pitch of the roof in the space between the lower face of the ridge capping and the upper face of the roof plate. More specifically, the rainwater running up toward the ridge against the pitch of the roof (for convenience, hereinafter such rainwater is called the penetrating rainwater) is blocked by the first inter-convex projection board on the pole plate side.

This inter-convex projection plate is protruded from the lower face of the ridge capping. The penetrating rainwater may continue running up toward the ridge through the gap between the end of the inter-convex projection plate and the roof plate. The blockage of the inter-convex projection plate, however, significantly reduces the quantity of the penetrating rainwater that runs through the inter-convex projection plate toward the ridge. The penetrating rainwater running through the inter-convex projection plate is then blocked by the roof plate-side projection board, which is protruded from the upper face of the roof plate and is located above the first inter-convex projection board along the pitch of the roof.

The penetrating rainwater running through the inter-convex projection plate should have a sufficient volume to run over the end of the roof plate-side projection board on the upper face of the roof plate and continue flowing up toward the ridge. The volume of the penetrating rainwater flowing up toward the ridge through the inter-convex projection plate is, however, significantly reduced by the blockage of the inter-convex projection plate. It is thus substantially impossible that the penetrating rainwater running through one inter-convex projection plate runs over the upper roof plate-side projection board along the pitch of the roof and continues flowing up toward the ridge. In the preferable structure that the inter-convex projection plates on the lower face of the ridge capping and the roof plate-side projection board on the upper face of the roof plate are arranged alternately along the pitch of the roof, the penetrating rainwater has less chance of flowing up toward the ridge. The inter-convex projection plate on the lower face of the ridge capping and the roof plate-side projection board on the upper face of the roof plate respectively fit in the recess defined by the adjoining convexes on the upper face of the roof plate. This arrangement ensures the efficient blockage of rainwater by these projection plate and projection board and effectively prevents the flow of penetrating rainwater toward the ridge. The roof of the present invention thus attains the effective rainfall measure against even heave rain with gale. The especially effective rainfall measure is expected in the preferable structure where the ridge capping has the multiple inter-convex projection plates along the pitch of the roof and the roof plate-side projection board of the roof plate is interposed between the adjoining inter-convex projection plates.

In the roof of the present invention having the effective rainfall measure, the ridge capping is fixed to the ridgepole of the roof only by means of the capping fixation member, and no nails or screws penetrating the roof plate are used for fixation of the ridge capping. The use of the readily fastened capping fixation member, such as bolts and nuts, facilitates fixation of the ridge capping to the ridge pole as well as detachment thereof. Especially the capping fixation member that strains the ridge capping toward the ridge pole for fixation (for example, long bolts and nuts) ensures easy attachment and detachment from the side below the ridgepole.

No use of a nail or screw penetrating the roof plate for fixation of the ridge capping does not make any through hole in the roof plate. This arrangement is free from the potential troubles described previously, such as rusting and damage of any constituent, due to formation of the through hole. The effective rainfall measure attained by the structure of the roof further ensures prevention of such potential troubles.

The shape of the convex may be rectangular, trapezoidal, triangular, or semi-spherical.

The roof plate-side projection board protruded from the upper face of the roof plate is located upstream the uppermost inter-convex projection plate of the ridge capping closest to the ridgepole to face the inter-convex projection plate.

Namely the roof plate-side projection board projected from the upper face of the roof plate is located upstream along the pitch of the roof (that is, the side close to the ridgepole) in the space between the lower face of the ridge capping and the upper face of the roof plate. The upstream projection board close to the ridgepole eventually blocks the upward flow of the penetrating rainwater. This further enhances effects of the rainfall measure.

In one preferable embodiment of the roof of the present invention, the inter-convex projection plate has a lower air vent on a lower projection end thereof to allow ventilation of the air along the upper face of the roof plate, and the roof plate-side projection board has an upper air vent on an upper projection end thereof to allow ventilation of the air along the lower face of the ridge capping. The respective air vents may be a notch formed on the lower projection end of the inter-convex projection plate and a notch formed on the upper projection end of the roof plate-side projection board. In another example, the projection length of the inter-convex projection plate is specified to make a gap between its lower end and the upper face of the roof plate, whereas the projection length of the roof plate-side projection board is specified to make a gap between its upper end and the lower face of the ridge capping. These gaps may be the respective air vents.

This structure allows exchange of the air surrounding the ridge pole with the outside air via the lower air vent on the lower end of the inter-convex projection plate and the upper air vent on the upper end of the roof plate-side projection board in the space between the lower face of the ridge capping and the upper face of the roof plate. The building structure that allows exchange of the air inside the building with the air surrounding the ridge pole attains ventilation of the air inside the building and above the ceiling via the ridge at the peak of the roof, thus improving the residential environment.

The convex of the roof plate should be in a covered area with the ridge capping, and preferably has a length identical with the length of the roof plate. This simplifies manufacture of the roof plate with the convex. The roof plate with the convex can thus be manufactured readily by extrusion molding of a metal or a resin. When the roof plate and the convex are both made of a metal material, the convex is easily formed by bending.

In the roof of the present invention, the roof plate may integrally include a roof plate member that is located above a roof frame member (a sheathing roof board or a roof rafter) disposed between the ridgepole and the pole plates along the pitch of roof, a hollow support member that props up the roof plate member apart from the roof frame member, and the convex.

When the roof plate member is laid to cover the roof frame member, such as the roof rafter or the sheathing roof board on the roof rafter, the support member mounted on the sheathing roof board or the roof rafter props up the roof plate member apart from the sheathing roof board or the roof rafter. Since the roof plate member is propped up by the support member to be apart from the roof frame member like the sheathing roof board or the roof rafter, there is an air layer between the roof frame member and the roof plate member. The cavity of the hollow support member also forms the air layer. The air layer functions as a soundproof layer against the pattering sound of raindrops and as a heat insulating layer against the temperature change of the roof plate member with the varying environment, thus exerting the excellent sound isolating and the heat insulating effects. The air layer is communicable with the space between the lower face of the ridge capping and the upper face of the roof plate. The air in the air layer is accordingly exchangeable with the outside air via the lower air vent on the lower end of the inter-convex projection plate and the upper air vent on the upper end of the roof plate-side projection board. Even when the radiation from the sun heats up the roof plates and heightens the temperature of the air in the air layer during the daytime, as in the summer season, this structure enables the hot air in the air layer to be discharged and vented during the night. The arrangement thus effectively prevents the temperature rise inside the building via the roof.

It is preferable that the roof plate has a net inside the convex or in a space between the roof frame member and the roof plate member propped up by the leg and the support member to prevent invasion of small animals like rats and insects.

There is no specific restriction in material applicable for the respective constituents of the roof, such as the ridge capping and the roof plates described above, partly because of no formation of through holes. Namely there is a high degree of freedom in selection of the suitable material, which is light in weight and inexpensive and has good processibility. Available materials include diverse metals, plastics, plaster boards, and glasses. Application of the metal material to the roof plate member gives the favorable durability and weather resistance. In such cases, the air layer defined by the support member below the roof plate member preferably has a dimension of 50 mm to 150 mm for the sufficient sound isolating and heat insulating effects.

From the viewpoints of processibility and durability, it is preferable that the roof plate including the roof plate member and the support member and the ridge capping covering the roof plate are made of a metal. Steel, pure iron, titanium, stainless steel, and aluminum are especially preferable for the better durability. By taking into account the weight and the effective prevention of warp or deformation, the preferable thickness of the roof plate member and the support member of the roof plate and the ridge capping is in a range of 1.5 mm to 5 mm. The roof plate member, the support member, and the convex may be molded integrally, for example, by extrusion molding, to form the roof plate of the enhanced durability.

A plurality of the roof plate members may be laid longitudinally to shingle the roof. In this application, the roof plate member is a board of a predetermined width and has joint members on both sides across its width to make each adjoining pair of the roof plate members joined with each other. The joint member has a leg, which is protruded from an end of the roof plate member and props up the roof plate member at the end apart from the sheathing roof board or the roof rafter. The leg has a height substantially identical with the height of the support member.

In this application, the roof plate member is propped up by the support member, while the end of the roof plate member is propped up by the leg of the joint member apart from the sheathing roof board or the roof rafter. This arrangement effectively prevents warp or any deformation of the roof plate member.

By taking into account the suitable number of roof plate members that are longitudinally laid to shingle the roof, the width of the roof plate member is preferably in a range of 450 mm to 1200 mm or more preferably in a range of 600 mm to 1000 mm. Such dimension ensures the easy handling of the roof plate members.

In the case of longitudinal shingling of the roof, the joint member is preferably provided with a rainproof mechanism for preventing penetration of rainwater. One embodiment of the rainproof mechanism is discussed below.

A quasi J-shaped rainwater shielding member is attached to each of the two side ends of the roof plate member. The fold and the portion facing thereto (facing part) of the rainwater shielding member defines a groove at each side end of the roof plate member. The remaining portion (residual part) of the rainwater shielding member extended upward from the facing part separates the groove from the roof plate member and makes the side wall of the groove extended at the side end of the roof plate member. The roof plate member has the rainwater shielding members on both side ends in a rotationally symmetrical manner. At one side end, the groove has an upper opening and is located on the side of the sheathing roof board or the roof rafter, while the residual part is extended upward from the roof plate member. At the other side end, the groove has a lower opening and is located above the roof plate member, while the residual part is extended downward from the roof plate member toward the sheathing roof board or the roof rafter. In the roof shingled by longitudinally laying the roof plates, the quasi J-shaped rainwater shielding members formed at the side ends of adjoining roof plate members are fitted in and joined with each other, in such a manner that the residual part extended downward from one roof plate member enters the upward opening of the groove at the joint of the other roof plate member and that the lower opening of the groove at the joint of one roof plate member covers the residual part extended upward from the other roof plate member. In this coupling state, one roof plate member and its rainwater shielding member block the upper opening of the groove at the joint of the other roof plate member.

At the joint of each end of the roof plate member, the quasi J-shaped rainwater shielding members oriented upright in the vertical direction are fitted in each other. The inverted J-shaped rainwater shielding member of the fitting prevents penetration of rainwater. While the rainwater shielding members are oriented upright, the roof plate members and the rainwater shielding members as the joint members are inclined along the pitch of the roof. Even when a little quantity of rainwater enters the joint of the rainwater shielding members by any chance, the J-shaped joint member works as a gutter for flowing the rainwater down and effectively keeps the sheathing roof boards from rainwater. The joint does not adopt any mechanically tight fixation mechanism but simply makes the J-shaped elements fitted in each other. The joint effectively absorbs a shape change of the roof plate member over time or with a variation in thermal expansion, thus preventing accumulation of useless stresses. The structure of the joint also facilitates recovery and recycle of the used roof plates. The structure does not require any processing, such as bending, in the field of roofing, thus further enhancing the workability.

From the viewpoints of processibility and durability, it is preferable that the joint member (rainwater shielding member) is made of a metal, like the roof plate member. Steel, pure iron, titanium, stainless steel, and aluminum are especially preferable for the better durability. By taking into account the weight and the effective prevention of warp or deformation, the preferable thickness of the joint member (rainwater shielding member) is identical with the thickness of the roof plate member and is in the range of 2 mm to 4 mm.

From the viewpoints of productivity and durability, it is preferable that the joint member (rainwater shielding member) is welded to the roof plate member. Seamless welding is desirable for the high water proofing property. In the case where a metal of excellent processibility is applied for the roof plate member, its two side ends may be bent to form the joint members. The integrally molded roof plate member with joint members (rainwater shielding members), for example, by extrusion molding, ensures the higher durability and water proofing property.

Another embodiment of the rainproof mechanism is discussed below.

The roof plate member applicable for the longitudinally shingled roof has a convex body projected upward at one side end thereof. The roof plate member is also provided with a rainwater shielding member at the other side end thereof. The rainwater shielding member of the roof plate member has an inner convex that is protruded upward to be fitted in the convex body of an adjoining roof plate member, and a lower convex that connects with the inner convex and is protruded downward. The inner convex and the lower convex are formed by bending. The rising side end of the lower convex comes into contact with the lower face of the adjoining roof plate member.

In this rainproof mechanism, at the joint of one roof plate member with an adjoining roof plate member, that is, below the convex body of the adjoining roof plate member, the lower convex of one roof plate member defines a groove and the inner convex parts the inside of the convex body of the adjoining roof plate member. In this state, the convex body of the adjoining roof plate member covers over the groove defined by the lower convex of one roof plate member. The groove of the lower convex is accordingly separated from the left and right roof plate members, and the opening of the groove is closed.

At the joint of adjoining roof plate members, the inner convex located inside the convex body prevents penetration of rainwater. While the rainwater shielding member is covered with the convex body, the roof plate member and the rain shielding member as the joint member are inclined along the pitch of the roof. Even when some rainwater enters the inside of the convex body, the penetrating rainwater is blocked by the inner convex. The rainwater should run over the inner convex to reach the lower convex. This arrangement significantly reduces the quantity of rainwater entering the lower convex. The lower convex functions as a gutter and flows the penetrating rainwater down to the pole plate side, thereby effectively preventing penetration of rainwater. The joint does not adopt any mechanically tight fixation mechanism but simply makes the inner convex fitted in the convex body. The joint effectively absorbs a shape change of the roof plate member over time or with a variation in thermal expansion, thus preventing accumulation of useless stresses. The structure of the joint also facilitates recovery and recycle of the used roof plates. The structure does not require any processing, such as bending, in the field of roofing, thus further enhancing the workability.

In order to attain at least part of the objects described previously, the present invention is also directed to a first roof plate, where a plurality of the roof plates are joined with and fixed to one another on the sheathing roof boards. The first roof plate includes: a roof plate member that is a long board of a predetermined width; a joint member that has a substantially J-shaped cross section and includes a leg, which is a broad, long plate having an identical length with a length of the roof plate member, and a fold, which has substantially half a width of the leg, the leg and the fold being joined with each other along their longitudinal sides, a substantial center of the leg being attached to each longitudinal side of the roof plate member at practically right angles in such a manner that the fold is located outside and the two joint members are rotationally symmetrical about the roof plate member; and a fixation member that is attached to the roof plate member to fix the roof plate member to a roof frame member.

In the first roof plate of the present invention having the substantially J-shaped joint member attached to each longitudinal side of the roof plate member, the fold and the portion of the leg facing thereto defines a groove on the longitudinal side of the roof plate member. The remaining portion of the leg (residual leg part) separates the groove from the roof plate member and makes the side wall of the groove extended on the longitudinal side of the roof plate member. The roof plate member has the joint members on both longitudinal sides in a rotationally symmetrical manner. On one longitudinal side, the groove has an upper opening and is located on the side of the roof frame member (the sheathing roof board or the roof rafter), while the residual leg part is extended upward from the roof plate member. On the other longitudinal side, the groove has a lower opening and is located above the roof plate member, while the residual leg part is extended downward from the roof plate member toward the roof frame member (the sheathing roof board or the roof rafter). In the roof shingled by laying the roof plates, the quasi J-shaped joint members formed on the longitudinal sides of adjoining roof plate members are fitted in and joined with each other, in such a manner that the residual leg part extended downward from one roof plate member enters the upward opening of the groove in the joint member of the other roof plate member and that the lower opening of the groove in the joint member of one roof plate member covers the residual leg part extended upward from the other roof plate member. In this coupling state, one roof plate member and its joint member block the upper opening of the groove in the joint member of the other roof plate member. The roof plate member is fixed to the sheathing roof board or the roof rafter by means of the fixation member attached to the roof plate member.

At the joint of the roof plate members, that is, at the coupling of the joint members, the quasi J-shaped joint members are oriented upright in the vertical direction. The inverted J-shaped joint member of the coupling prevents penetration of rainwater. While the joint members are oriented upright, the roof plate members and the joint members are inclined along the pitch of the roof. Even when a little quantity of rainwater enters the coupling of the joint members by any chance, one J-shaped joint member of the coupling works as a gutter for flowing the rainwater down and effectively keeps the roof frame members (the sheathing roof boards and the roof rafters) from rainwater. The joint does not adopt any mechanically tight fixation mechanism but simply makes the J-shaped parts of the joint members fitted in each other. The joint effectively absorbs a shape change of the roof plate member over time or with a variation in thermal expansion, thus preventing accumulation of useless stresses. The structure of the joint also facilitates recovery and recycle of the used roof plates. The structure does not require any processing, such as bending, in the field of roofing, thus further enhancing the workability.

By taking into account the suitable number of roof plate members used for roofing, the width of the roof plate member is preferably in a range of 450 mm to 1200 mm or more preferably in a range of 600 mm to 1000 mm. Such dimension ensures the easy handling of the roof plate members. The preferable height of the leg of the joint member ranges from 50 mm to 150 mm to completely prevent penetration of rainwater. The preferable height of the fold is accordingly in a range of 25 mm to 75 mm. The dimension of the joint of the fold with the leg is specified not to bite into the roof frame member (the sheathing roof board or the roof rafter).

The fixation member is preferably attached to a center portion of the roof plate member having a predetermined width. This arrangement keeps the position of the fixation member along the width even when the roof plate member is used upside down. In one preferable application, the fixation members are attached to both the upper face and the lower face of the roof plate member. This arrangement facilitates the fixation even when the roof plate member is used upside down. In this application, it is preferable that the fixation member on the upper face of the roof plate member is detachable for the better appearance.

The roof plate member is fixed to the roof frame member via the fixation member, so that an air layer corresponding to the height of the fixation member is formed in the space between the roof frame member (the sheathing roof board or the roof rafter) and the roof plate member. When a metal of high durability is applied for the roof plate member, this air layer functions as a soundproof layer against the metal-pattering sound of raindrops and as a heat insulating layer against the temperature change of the roof plate member with the varying environment, thus exerting the excellent sound isolating and the heat insulating effects. Namely there is a high degree of freedom in selection of the suitable material, which is light in weight and inexpensive and has good processibility, for the roof plate member. Available materials for the roof plate member include diverse metals, plastics, plaster boards, and glasses. The air layer formed by the fixation member in the space between the roof frame member (the sheathing roof board or the roof rafter) and the roof plate member preferably has a dimension of 50 mm to 120 mm for the sufficient sound isolating and heat insulating effects. The thickness of the air layer should be not less than the height of the leg. When the thickness of the air layer formed by the fixation member is identical with the height of the leg, the roof plate member can desirably be held above the roof frame member by both the fixation member and the leg.

From the viewpoints of processibility and durability, it is preferable that the roof plate member and the joint member are made of a metal. Steel, pure iron, titanium, stainless steel, and aluminum are especially preferable for the better durability. By taking into account the weight and the effective prevention of warp or deformation, the preferable thickness of the roof plate member and the joint member is in the range of 2 mm to 4 mm.

From the viewpoints of productivity and durability, it is preferable that the joint member is welded to the roof plate member. Seamless welding is desirable for the high water proofing property. In the case where a metal of excellent processibility is applied for the roof plate member, its two longitudinal sides may be bent to form the joint members. The integrally molded roof plate member with joint members, for example, by extrusion molding, ensures the higher durability and water proofing property.

It is preferable that the fixation member is composed of a material having the better heat insulating effect and/or the better vibration isolating effect than the roof plate member. This further enhances the heat insulating and sound isolating effects of the whole roof plate. Composite materials with glass short fibers or pitch carbon fibers as fillers (for example, glass fiber-containing plastics and carbon fiber-containing plastics) are desirably applicable for the fixation member.

In order to attain at least part of the objects described previously, the present invention is further directed to a second roof plate, where a plurality of the roof plates are horizontally laid on and fixed to a roof frame to define a roof appearance. The second roof plate includes: a roof plate member that is a long board of a predetermined width; a convex body that is attached to and protruded upward from one side of the roof plate member along a pitch of roof; a joint member that is attached to the other side of the roof plate member along the pitch of roof to be combined with the convex body of an adjoining roof plate member; and a fixation member that is attached to the roof plate member to prop up the roof plate member apart from the roof frame and fix the roof plate member to the roof frame. The joint member has: an inner convex that is protruded upward from the roof plate member to be fitted in the convex body of the adjoining roof plate member; and a lower convex that connects with the inner convex and is protruded downward from the roof plate member. The lower convex has a rising side end, which defines a convex shape on the other side of the roof plate and has an extension toward a lower face of the adjoining roof plate member.

In the second roof plate of the present invention, the convex body, which is protruded upward from the roof plate member, is attached to one side end of the roof plate member along the pitch of the roof, while the joint member is attached to the other side end of the roof plate member. In the roof shingled by longitudinally laying the roof plates of the present invention on the roof frame, the convex body of one roof plate member faces the joint member of an adjoining roof plate member along the pitch of the roof. In the structure of the present invention, the joint member is received in the convex body of the adjoining roof plate member. Namely the joint member of one roof plate member is fitted in and joined with the convex body of the other roof plate member. In the coupling state of the adjoining roof plate members, each roof plate member is propped up by the fixation member apart from the roof frame and is thereby fixed to the roof frame.

The joint member has the inner convex and the lower convex connecting with the inner convex. The inner convex is protruded upward from the roof plate member to be fitted in the convex body of the adjoining roof plate member. In the coupling state of the convex body with the joint member, the convex body of one roof plate member covers over the inner convex of the other roof plate member. The lower convex connects with the inner convex and is protruded downward from the roof plate member. The lower convex connecting with the inner convex covered with the convex body defines a groove having an upper opening on the side end of the roof plate member. The lower convex has the rising side end protruded toward the lower face of the adjoining roof plate member. The rising side end separates the groove from the roof plate member. This groove is covered with the convex body or with the adjoining roof plate member, since the lower convex connects with the inner convex covered with the convex body of the adjoining roof plate member. The cover of the inner convex with the convex body and the cover of the groove with the convex body or the adjoining roof plate member are along the pitch of the roof. The groove functions as a gutter to flow rainwater down along the pitch of the roof.

In the adjoining roof plate members of the longitudinally shingled roof, the convex body and the inner convex are both projected from the roof plate members in such a manner that the inner convex is covered with the convex body, and are inclined along the pitch of the roof. Even if the rainwater enters the convex body by any chance, the inner convex fitted in the convex body prevents further penetration of the rainwater and blocks the penetrating rainwater. The convex body and the inner convex are inclined along the pitch of the roof, so that the penetrating rainwater blocked by the inner convex is flown down along the pitch of the roof. This arrangement thus ensures the high rainproof effects.

If the rainwater runs over the inner convex fitted in the convex body by any chance, the penetrating rainwater is received by the groove, which is defined by the lower convex connecting with the inner convex and functions as the gutter. The penetrating water is thus flown down and discharged to the pole plate side. This arrangement thus effectively keeps the roof frame from rainwater. The joint of the adjoining roof plate members does not adopt any mechanically tight fixation mechanism but simply makes the inner convex of one roof plate member fitted in the convex body of the other roof plate member. The joint effectively absorbs a shape change of the roof plate member over time or with a variation in thermal expansion, thus preventing accumulation of useless stresses. The structure of the joint also facilitates recovery and recycle of the used roof plates. The structure does not require any processing, such as bending, in the field of roofing, thus further enhancing the workability.

By taking into account the suitable number of roof plate members used for roofing, the width of the roof plate member is preferably in a range of 450 mm to 1200 mm or more preferably in a range of 600 mm to 1000 mm. Such dimension ensures the easy handling of the roof plate members. The projection height of the inner convex that blocks the penetrating rainwater is preferably in a range of 50 mm to 150 mm, in order to completely prevent penetration of rainwater. The convex body should be projected to cover the inner convex. When both the convex body and the inner convex are rectangular, the width of the projection is preferably in a range of 25 mm to 75 mm. More specifically, it is preferable that the projection width of the convex body is wider than the projection width of the inner convex in this range. The lower convex defining the groove as the gutter is preferably a rectangle having a width of 25 mm to 50 mm. The width of the lower convex in this range desirably prevents the lower convex from biting into the roof frame, even when the lower convex is directly in contact with the roof frame.

The roof plate member is fixed to the roof frame via the fixation member, so that an air layer corresponding to the height of the fixation member is formed in the space between the board of the roof frame (for example, the sheathing roof board) and the roof plate member. When a metal of high durability is applied for the roof plate member, this air layer functions as a soundproof layer against the metal-pattering sound of raindrops and as a heat insulating layer against the temperature change of the roof plate member with the varying environment, thus exerting the excellent sound isolating and the heat insulating effects. The air layer formed by the fixation member preferably has a dimension of 50 mm to 120 mm for the sufficient sound isolating and heat insulating effects. When the thickness of the air layer formed by the fixation member is identical with the projection height of the lower convex, the roof plate member can desirably be held above the roof frame by both the fixation member and the lower convex.

From the viewpoints of processibility and durability, it is preferable that the roof plate member as well as the convex body and the joint member on both side ends thereof are made of a metal. Steel, pure iron, titanium, stainless steel, and aluminum are especially preferable for the better durability. By taking into account the weight and the effective prevention of warp or deformation, the preferable thickness of the roof plate member and the joint member is in the range of 2 mm to 6 mm.

In one preferable example, the convex body is formed by bending one side end of the metal roof plate member, while the inner convex and the lower convex of the joint member are formed by bending the other side end of the metal roof plate member. This arrangement is favorable for the high productivity, the high durability, the enhanced waterproof property, and the reduced cost. In the case where a metal of excellent processibility is applied for the roof plate member, the roof plate member, the convex body, and the joint member may be formed integrally, for example, by extrusion molding. This ensures the higher durability and water proofing property.

It is preferable that the fixation member is composed of a material having the better heat insulating effect and/or the better vibration isolating effect than the roof plate member. This further enhances the heat insulating and sound isolating effects of the whole roof plate. Composite materials with glass short fibers or pitch carbon fibers as fillers (for example, glass fiber-containing plastics and carbon fiber-containing plastics) are desirably applicable for the fixation member.

The inner convex may have a top face that is in contact with a bottom face of the convex body of the adjoining roof plate member.

This arrangement effectively prevents the rainwater entering the convex body from running over the inner convex, and thereby attains the favorable water proofing property. The inner convex props up the convex body. In the structure that the lower convex connecting with the inner convex is in contact with the roof frame, the convex body is preferably propped up by the lower convex and the inner convex.

In one preferable structure, the lower convex has a flange on an upper edge of the rising side end, which comes into contact with a lower face of the roof plate member. The convex body has a falling side end that is extended toward an upper face of an adjoining roof plate member to form a flange on a lower edge thereof, which comes into contact with the upper face of the adjoining roof plate member.

In this structure, the flange on the upper edge of the rising side end of the lower convex props up the roof plate member, while the flange on the lower edge of the falling side end of the convex body supports the whole convex body.

The lower convex of the joint member may have a greater projection height than a projection height of the convex body across the roof plate member.

The groove defined by the lower convex accordingly has the greater depth than the projection height of the inner convex fitted in the convex body. The groove of such dimension effectively causes the rainwater running over the inner convex fitted in the convex body to be flown down and discharged to the pole plate side, thus ensuring the enhanced water proofing property.

In order to attain at least part of the objects described previously, the present invention is also directed to a third roof plate, where a plurality of the roof plates are laid to shingle a roof and define a roof appearance. The third roof plate integrally includes: a roof plate member, which is a board; and a hollow support member that is arranged on an upper face of a roof frame member along a pitch of roof to prop up the roof plate member apart from the roof frame member. The support member has a fixation hole, which is formed in a bottom face thereof that is in contact with the roof frame member, and receives a fixing element protruded from the roof frame member. The fixation hole has a positioning section that positions the fixing element, and a broader section that is wider than the fixing element, where the positioning section is located above the broader section along the pitch of roof.

In the third roof plate of the present invention, when the roof plate member is laid to cover the roof rafter or the sheathing roof board mounted on the roof rafter, the support member is located close to the sheathing roof board or the roof rafter to prop up the roof plate member apart from the roof frame member (the sheathing roof board or the roof rafter). In this state, the fixing element projected from either one of or both of the sheathing roof board and the roof rafter is received in the fixation hole formed in the bottom face of the support member. The fixing element is positioned by the upper positioning section of the fixation hole along the pitch of the roof. This causes the roof plate member and the whole roof plate to be positioned relative to the roof frame member (the sheathing roof board or the roof rafter). The sheathing roof board is generally laid on the roof rafter. In the roof shingled with the roof plates of the present invention, the roof plate may directly be mounted on the roof rafter without the sheathing roof board.

In one preferable application, one single support member has a plurality of the fixation holes, and a plurality of the fixing elements are provided corresponding to the plurality of fixation holes along the pitch of the roof. This arrangement enables the roof plate member and the whole roof plate to be securely positioned relative to the roof frame member (the sheathing roof board or the roof rafter). In another preferable application, a plurality of the support members with the fixation holes are arranged in parallel along the pitch of the roof, and a plurality of the fixing elements are provided according to the plurality of support members. This arrangement also enables the roof plate member and the whole roof plate to be securely positioned relative to the roof frame member (the sheathing roof board or the roof rafter).

The roof is shingled with the roof plates of the present invention by positioning the roof plate member and the whole roof plate relative to the roof frame member (the sheathing roof board or the roof rafter). The procedure first locates the roof plate above the roof frame member (the sheathing roof board or the roof rafter) to make the broader section of the fixation hole overlap the fixing element protruded from the sheathing roof board or the roof rafter. The procedure lifts down the roof plate onto the sheathing roof board or the roof rafter. The fixing element then enters the broader section. The procedure subsequently shifts the roof plate downward along the pitch of the roof. The fixing element received by the broader section then moves into the positioning section of the fixation hole and is positioned by the positioning section. This positions the roof plate member and the whole roof plate relative to the roof frame member (the sheathing roof board or the roof rafter) and completes roofing.

The reverse procedure should be performed to detach the roof plate from the roof frame member (the sheathing roof board or the roof rafter). The procedure shifts the roof plate upward along the pitch of the roof to make the fixing element located in the broader section, and lifts up the roof plate from the sheathing roof board or the roof rafter.

The structure of the roof plate of the present invention desirably simplifies the roofing procedure as well as the detachment and relocation procedure. As the roof plate member is propped up by the support member apart from the sheathing roof board or the roof rafter, there is an air layer in the space between the sheathing roof board and the roof plate member. The cavity of the hollow support member also forms the air layer. The air layer functions as a soundproof layer against the pattering sound of raindrops and as a heat insulating layer against the temperature change of the roof plate member with the varying environment, thus exerting the excellent sound isolating and the heat insulating effects. There is accordingly a high degree of freedom in selection of the suitable material, which is light in weight and inexpensive and has good processibility, for the roof frame member. Available materials for the roof plate member include diverse metals, plastics, plaster boards, and glasses. Application of the metal material to the roof plate member gives the favorable durability and weather resistance. In such cases, the air layer defined by the support member below the roof plate member preferably has a dimension of 50 mm to 150 mm for the sufficient sound isolating and heat insulating effects.

From the viewpoints of processibility and durability, it is preferable that the roof plate member and the support member are made of a metal. Steel, pure iron, titanium, stainless steel, and aluminum are especially preferable for the better durability. By taking into account the weight and the effective prevention of warp or deformation, the preferable thickness of the roof plate member and the support member is in a range of 1.5 mm to 5 mm. The roof plate member and the support member be molded integrally, for example, by extrusion molding, for the enhanced durability.

A plurality of the roof plates may be laid longitudinally to shingle the roof. In this application, the roof plate member is a board of a predetermined width and has joint members on both sides across its width to make each adjoining pair of the roof plate members joined with each other. The joint member has a leg, which is protruded from an end of the roof plate member and props up the roof plate member at the end apart from the roof frame member (the sheathing roof board or the roof rafter). The leg has a height substantially identical with the height of the support member.

In this application, the roof plate member is propped up by the support member, while the end of the roof plate member is propped up by the leg of the joint member apart from the roof frame member (the sheathing roof board or the roof rafter). This arrangement effectively prevents warp or any deformation of the roof plate member.

By taking into account the suitable number of roof plate members that are longitudinally laid to shingle the roof, the width of the roof plate member is preferably in a range of 450 mm to 1200 mm or more preferably in a range of 600 mm to 1000 mm. Such dimension ensures the easy handling of the roof plate members.

In the case of longitudinal shingling of the roof, the joint member is preferably provided with a rainproof mechanism for preventing penetration of rainwater. One embodiment of the rainproof mechanism is discussed below.

A quasi J-shaped rainwater shielding member is attached to each of the two side ends of the roof plate member. The fold and the portion facing thereto (facing part) of the rainwater shielding member defines a groove at each side end of the roof plate member. The remaining portion (residual part) of the rainwater shielding member extended upward from the facing part separates the groove from the roof plate member and makes the side wall of the groove extended at the side end of the roof plate member. The roof plate member has the rainwater shielding members on both side ends in a rotationally symmetrical manner. At one side end, the groove has an upper opening and is located on the side of the sheathing roof board or the roof rafter, while the residual part is extended upward from the roof plate member. At the other side end, the groove has a lower opening and is located above the roof plate member, while the residual part is extended downward from the roof plate member toward the sheathing roof board or the roof rafter. In the roof shingled by longitudinally laying the roof plates, the quasi J-shaped rainwater shielding members formed at the side ends of adjoining roof plate members are fitted in and joined with each other, in such a manner that the residual part extended downward from one roof plate member enters the upward opening of the groove at the joint of the other roof plate member and that the lower opening of the groove at the joint of one roof plate member covers the residual part extended upward from the other roof plate member. In this coupling state, one roof plate member and its rainwater shielding member block the upper opening of the groove at the joint of the other roof plate member.

At the joint of each end of the roof plate member, the quasi J-shaped rainwater shielding members oriented upright in the vertical direction are fitted in each other. The inverted J-shaped rainwater shielding member of the fitting prevents penetration of rainwater. While the rainwater shielding members are oriented upright, the roof plate members and the rainwater shielding members as the joint members are inclined along the pitch of the roof. Even when a little quantity of rainwater enters the joint of the rainwater shielding members by any chance, the J-shaped joint member works as a gutter for flowing the rainwater down and effectively keeps the sheathing roof boards from rainwater. The joint does not adopt any mechanically tight fixation mechanism but simply makes the J-shaped elements fitted in each other. The joint effectively absorbs a shape change of the roof plate member over time or with a variation in thermal expansion, thus preventing accumulation of useless stresses. The structure of the joint also facilitates recovery and recycle of the used roof plates. The structure does not require any processing, such as bending, in the field of roofing, thus further enhancing the workability.

From the viewpoints of processibility and durability, it is preferable that the joint member (rainwater shielding member) is made of a metal, like the roof plate member. Steel, pure iron, titanium, stainless steel, and aluminum are especially preferable for the better durability. By taking into account the weight and the effective prevention of warp or deformation, the preferable thickness of the joint member (rainwater shielding member) is identical with the thickness of the roof plate member and is in the range of 2 mm to 4 mm.

From the viewpoints of productivity and durability, it is preferable that the joint member (rainwater shielding member) is welded to the roof plate member. Seamless welding is desirable for the high water proofing property. In the case where a metal of excellent processibility is applied for the roof plate member, its two side ends may be bent to form the joint members. The integrally molded roof plate member with joint members (rainwater shielding members), for example, by extrusion molding, ensures the higher durability and water proofing property.

In accordance with another preferable application, the fixing element for fixing the roof plate includes: a washer that is located above the roof frame member and has an inclined or spherical surface on one side thereof close to the roof frame member; a shaft member that penetrates the washer and the roof frame member from a top face side of the washer; and a straining member that strains the shaft member from a bottom face side of the roof frame member for fixation.

In this arrangement, the shaft member is fitted in the positioning section of the fixation hole to attain positioning, and the inclined or spherical lower surface of the washer presses the circumference of the positioning section. Even when the roof plate is exposed to a lifting force due to a high gale, this arrangement effectively prevents the roof plate from being lifted up from the roof frame member (the sheathing roof board or the roof rafter). The inclined or spherical surface of the washer has additional advantages discussed below.

The roof plate member can be shifted downward along the pitch of the roof, while the fixing element (the shaft member penetrating the washer) is located in the broader section of the fixation hole. The downward shift causes the fixing element (the shaft member penetrating the washer) to move into the positioning section of the fixation hole. In this process, the washer is not stuck on the circumferential wall of the fixation hole, because of its inclined or spherical surface. This structure accordingly ensures smooth shift of the roof plate member and facilitates the roofing procedure.

In one preferable embodiment, the shaft member is a bolt and the straining member, which strains the shaft member from the bottom face side of the roof frame member (the sheathing roof board or the roof rafter) for fixation, is a nut. The shaft member is readily fixed to the roof frame member (the sheathing roof board or the roof rafter) by the clamping force of the nut.

The nut and the bolt end may be covered with a cap nut. For the enhanced design effects, the design surface of the cap nut is specified to match the grain and the pattern on the rear face of the sheathing roof board.

BRIEF DESCRIPTION OF THE DRAWINGS

FIG. 4(*a*) is a plan view of the main part of the roof plate 10 seen from the top, and FIG. 4(*b*) is a front view of main part of the roof plate 10 seen from the front;

BEST MODES OF CARRYING OUT THE INVENTION

Figure 1:
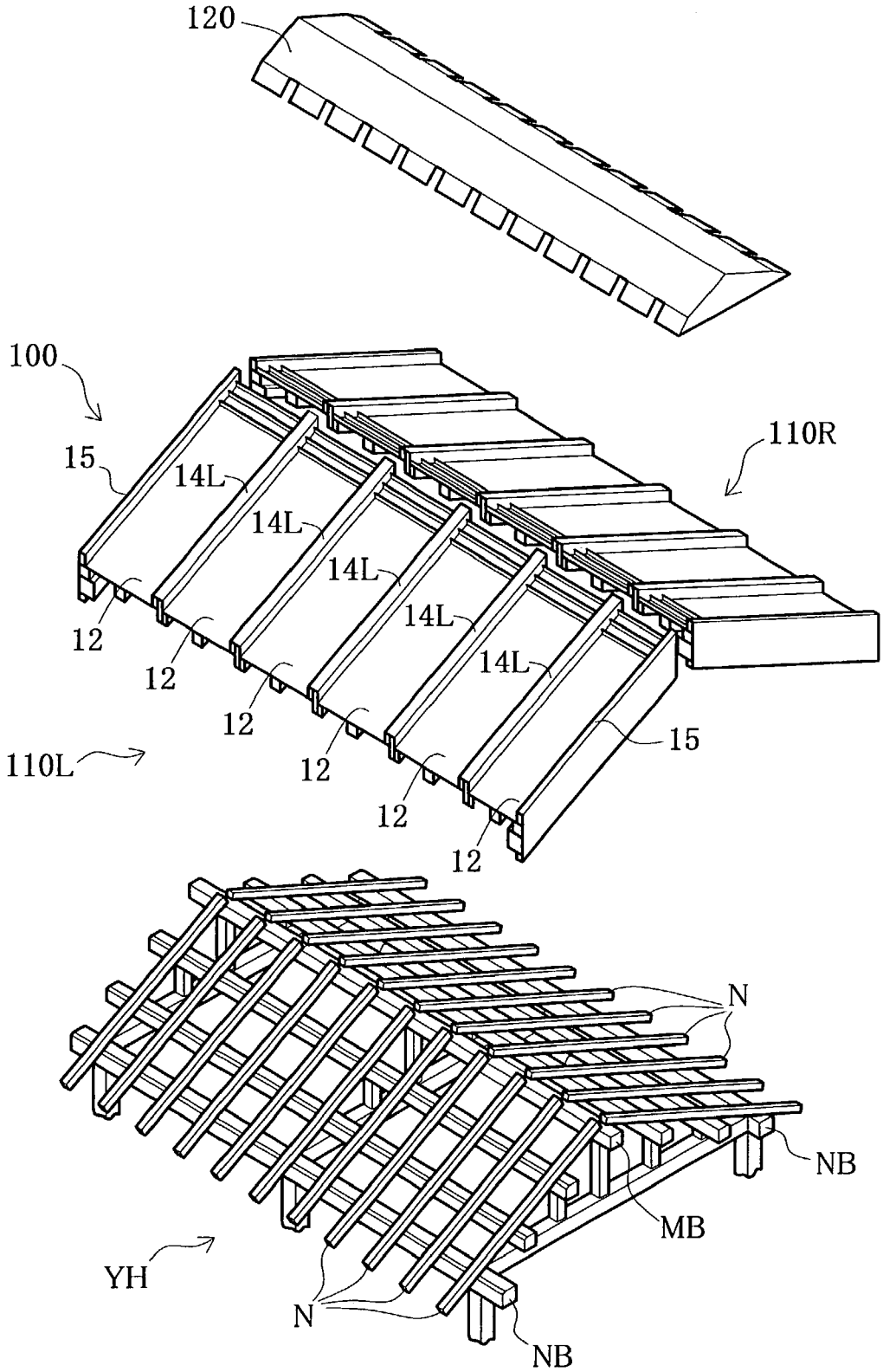
FIG. 1 schematically illustrates the general structure of a roof 100 in a first embodiment.

In order to further clarify the structures and the functions of the present invention, some modes of embodying the roof of the present invention are discussed below. FIG. 1 schematically illustrates the general structure of a roof 100 in a first embodiment. The general structure is discussed first with reference to FIG. 1.

As illustrated, the roof 100 of this embodiment has a gabled roof frame YH, left and right roofing assemblies 110L and 110R attached on both sides of the ridge of this roof frame YH with a predetermined pitch of roof, and a ridge capping 120 that covers the roofing assemblies 110L and 110R on both the sides of the roof at the ridge. The roofing assemblies 110L and 110R shingle the roof from a ridgepole MB to pole plates NB in the roof frame YH. The ridge capping 120 covers the roofing assemblies 110L and 110R along the roof width to form the ridge appearance of the roof. The roof frame YH includes roof rafters N spanned between the ridgepole MB and the pole plates NB. The ridgepole MB and the roof rafters N are supported by posts H using purlins, tie beams, vertical roof struts, and gable beams. The roofing assembly is discussed below in detail.

Figure 2:
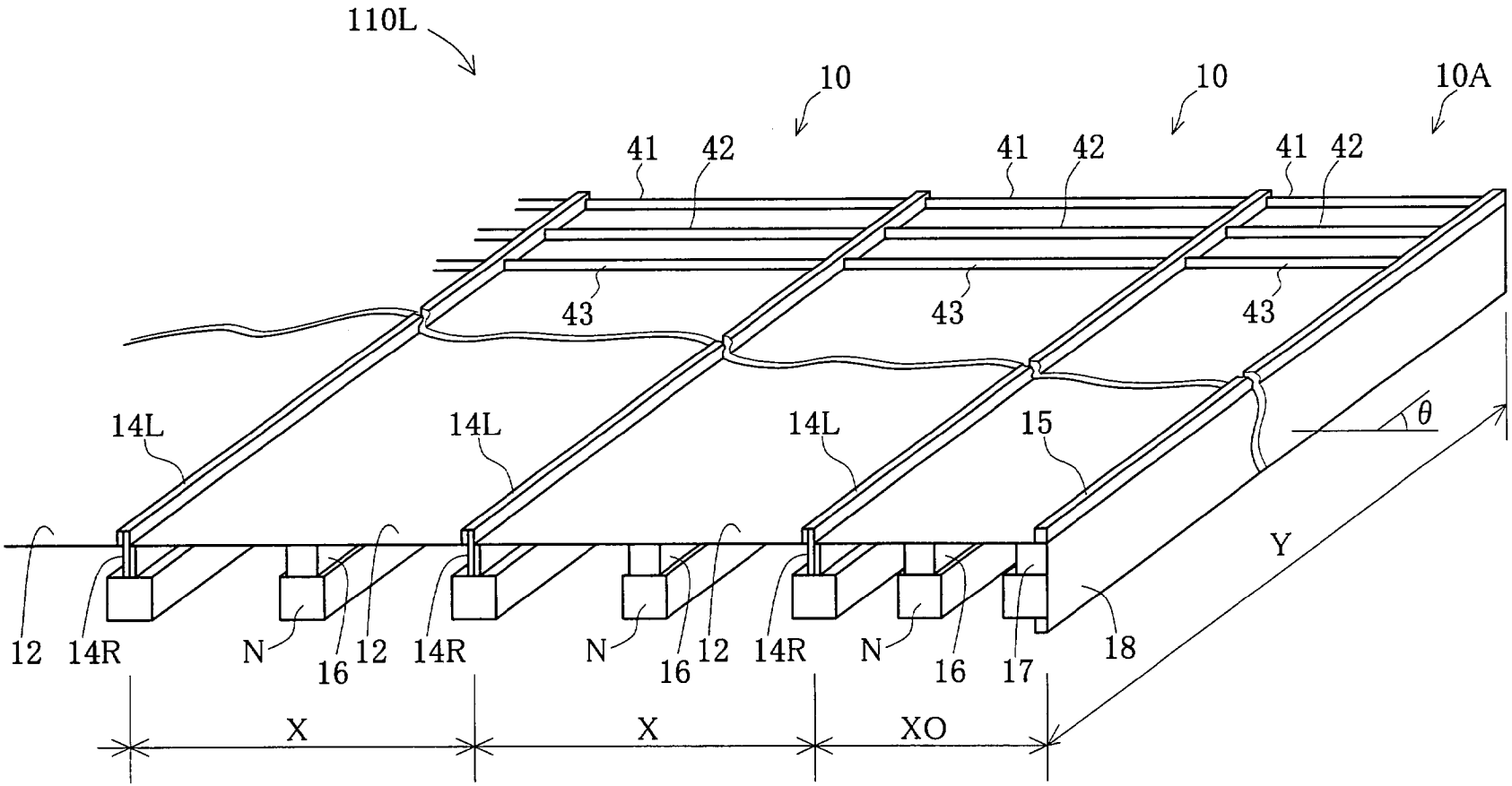
FIG. 2 shows a roofing assembly 110L including multiple roof plates 10 longitudinally laid to shingle a roof.
Figure 3:
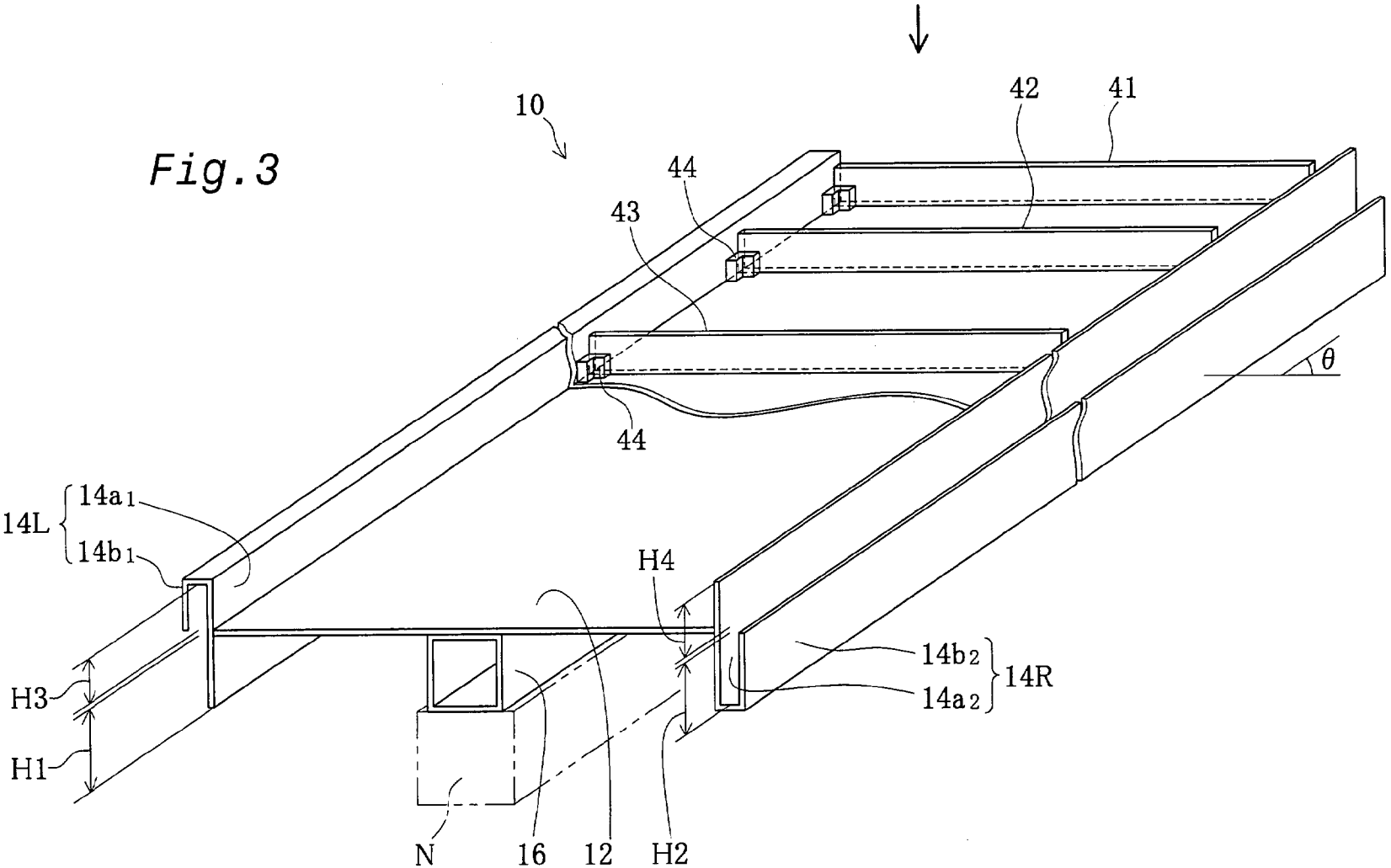
FIG. 3 is a perspective view schematically illustrating the roof plate 10.
Figure 4A:
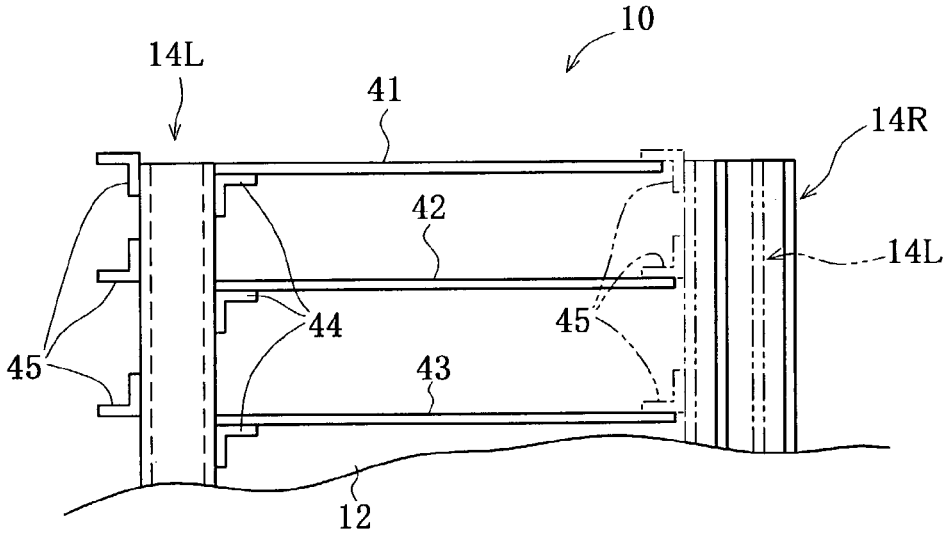
FIG. 4 shows a main part of the roof plate 10.
Figure 4B:
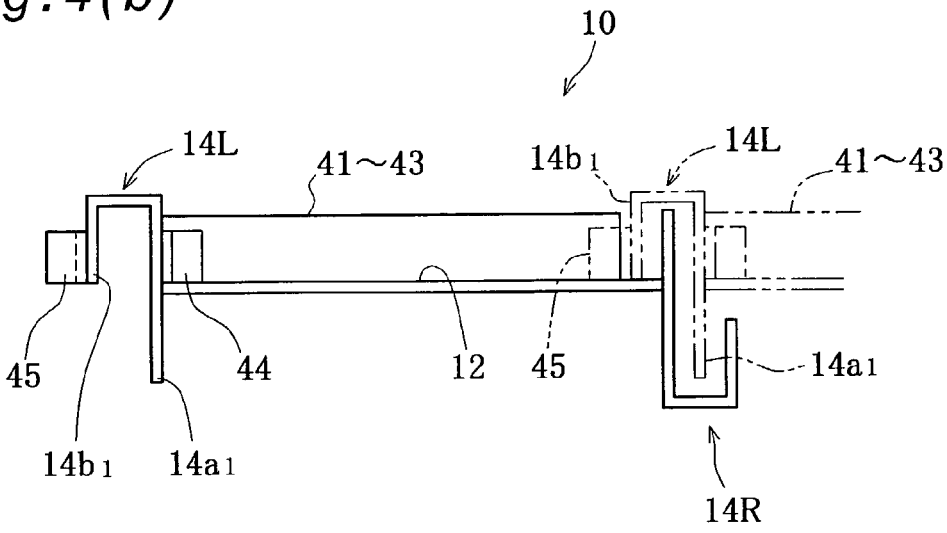
Figure 5:
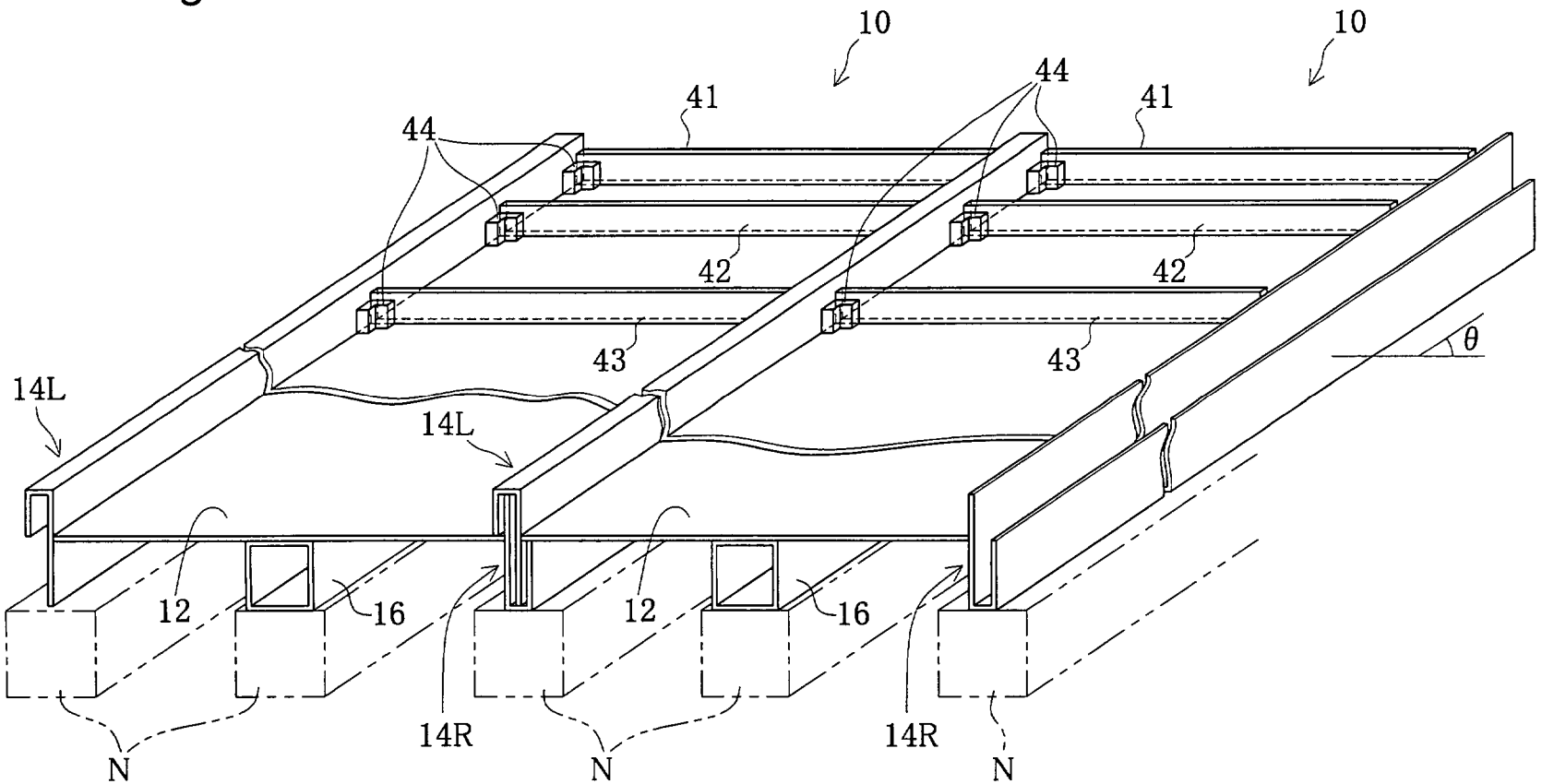
FIG. 5 is a perspective view illustrating joint of the roof plates 10.
Figure 6:
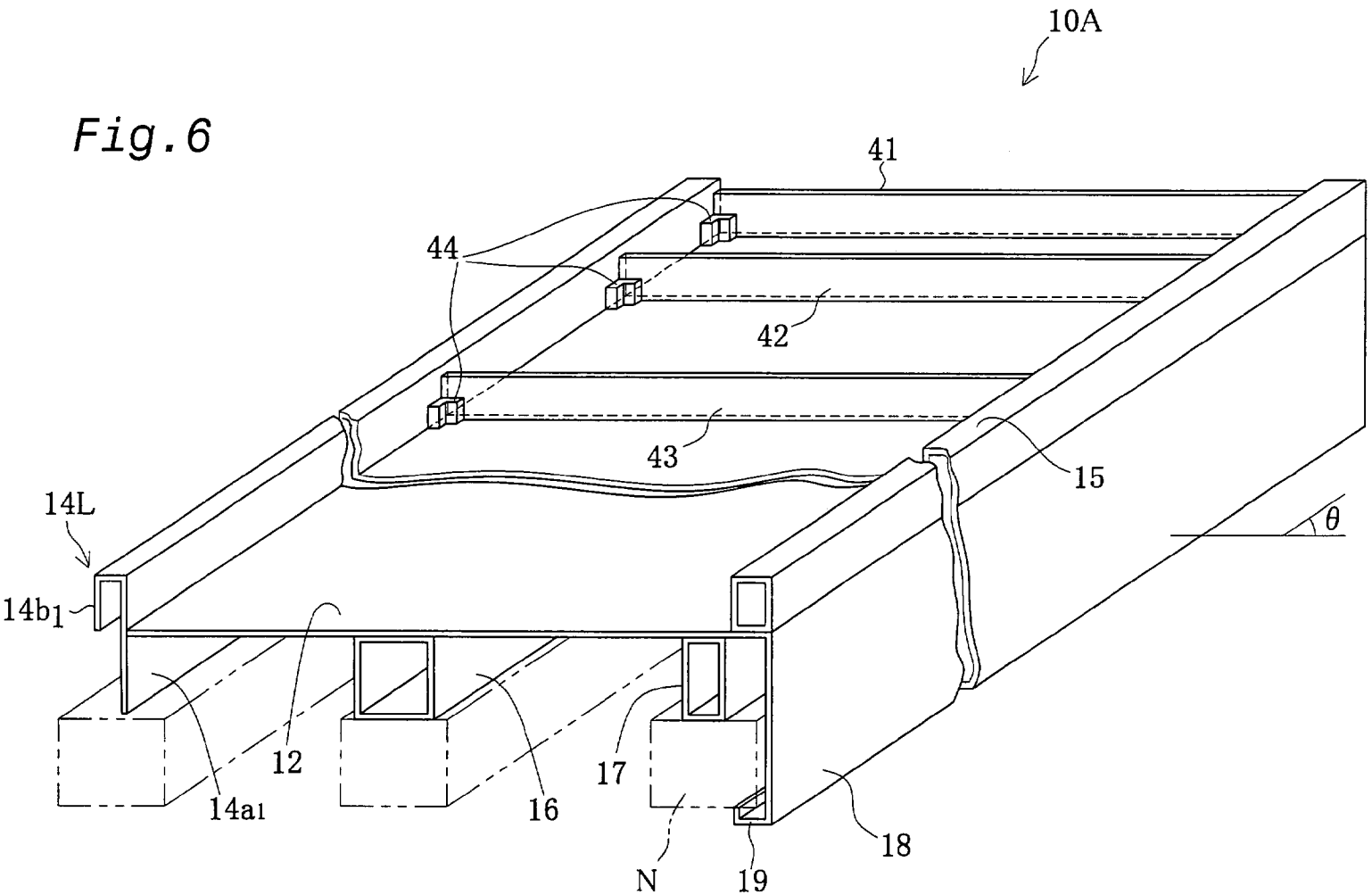
FIG. 6 is a perspective view schematically illustrating a roof plate 10A located on the gable end of the roof.

FIG. 2 shows the roofing assembly 110L including multiple roof plates 10 longitudinally laid to shingle the roof. FIG. 3 is a perspective view schematically illustrating the roof plate 10. FIG. 4 shows a main part of the roof plate 10 seen from the top and from the front. FIG. 5 is a perspective view illustrating joint of the roof plates 10. FIG. 6 is a perspective view schematically illustrating a roof plate 10A located on the gable end of the roof. The roofing assembly 110R is identical with the roofing assembly 110L with only difference in orientation of shingling.

As illustrated in these drawings, the roof plate 10 has a roof plate member 12, which is a long plate of a predetermined width, right and left joint members 14R and 14L attached to the two longitudinal sides of the roof plate member 12, and a fixation member 16 projected from a preset width of a center portion of the roof plate member 12 and fixed to the roof rafter N.

The left joint member 14L has a substantially J-shaped cross section and includes a leg 14*a*1, which is a broad, long plate having the same length as that of the roof plate member 12, and a fold 14*b*1 in a clinched shape. The leg 14*a*1 is attached to each longitudinal side of the roof plate member 12 at practically right angles in such a manner that the fold 14*b*1 is located outside. The right joint member 14R is rotationally symmetrical to the left joint member 14L, and includes a broad, long leg 14*a*2 and a fold 14*b*2 in a clinched shape. A height H1 of the joint member 14L between the lower face of the roof plate member 12 and the lower end of the leg 14*a*1 is designed to be substantially equal to a depth H2 of a lower groove, which is defined by the leg 14*a*2 and the fold 14*b*2 of the joint member 14R, from the lower face of the roof plate member 12. A depth H3 of an upper groove, which is defined by the leg 14*a*1 and the fold 14*b*1 of the joint member 14L, from the upper face of the roof plate member 12 is designed to be substantially equal to a height H4 of the joint member 14R between the upper face of the roof plate member 12 and the upper end of the leg 14*a*2.

The fixation member 16 is a hollow, quasi-square columnar body and is attached to the roof rafter N along the pitch of the roof. The outer dimension of the fixation member 16 is substantially equal to the sum of the height H2 of the lower groove formed by the joint member 14R and the board thickness of the fold 14*b*2. The fixation member 16, in cooperation with the right and left joint members 14R and 14L, accordingly props up the roof plate member 12 apart from the roof rafter N. The fixation member 16 has a structure for fixation of the roof plate, which will be discussed later.

A width X of the roof plate 10 having the above structure is, for example, equal to the width of a molded steel plate. A length Y of the roof plate 10 is determined according to the length of the roof to be shingled. The roof plates 10 of such dimensions are manufactured, processed, and are brought into the field for roofing. It is preferable that the height H1 of the leg 14*a*1 of the joint member 14L and the groove depth H2 of the joint member 14R (see FIG. 3) are shorter than the width X of the roof plate 10. In this embodiment, X is about 900 mm, Y is about 4000 mm, and the height H1 of the leg 14*a*1 and the groove depth H2 of the joint member 14R are approximately 95 mm. The groove depth H3 of the joint member 14L and the height H4 of the leg 14*a*2 of the joint member 14R are approximately 55 mm. The board thickness of each member is about 5 mm. The joint of the leg 14*a*2 with the fold 14*b*2 in the joint member 14R, which is in contact with the roof rafter N should have a dimension that prevents the joint from biting into the roof rafter N and ranges from 15 mm to 45 mm. In this embodiment, the dimension of the joint is 16 mm.

The roof plate member 12, the right and left joint members 14R and 14L, and the fixation member 16 are made of metal titanium that is light in weight and has excellent durability, and are firmly joined with one another by seamless welding. The fixation member 16 may have the same length as that of the roof plate member 12. Alternatively the fixation members 16 may be attached to the roof plate member 12 at preset intervals, for example, at intervals of about 2000 mm, along its longitudinal axis, by an appropriate technique, such as adhesion. A base face of the fixation member 16 is preferably made of the same metal material as that of the roof plate member 12. This allows application of any simple and secure fixing technique, such as welding, for fixation of the fixation member 16. In this case, the other faces of the fixation member 16 may be made of a composite material containing short fibers, such as carbon fibers and glass fibers, as fillers. The fixation member 16 of the composite material is manufactured by setting the metal material for the base face in a die and insert resin molding.

The roof plate 10 has a first projection board 41, a second projection board 42, and a third projection board 43 protruded from the upper face of the roof plate member 12. The respective projection boards are located close to the ridge in the shingled roof. The height of the projection boards is lower than the projected height of the joint members 14L from the upper face of the roof plate member 12 by approximately 10 mm. In the structure of this embodiment, the joint members 14L are protruded from the upper face of the roof plate member 12 by approximately 60 mm, while the first through the third projection boards are protruded by approximately 50 mm.

The first through the third projection boards are seamless welded to the upper face of the roof plate member 12, and are reinforced by L-shaped steel plates 44 at the respective positions of the joint and fixation to the joint member 14L. The length of the first through the third projection boards is specified as discussed below.

In the arrangement of the roof plates 10 for roofing, as shown in FIGS. 2 and 5, the joint member 14R of one roof plate member 10 is inserted upward into the joint member 14L of an adjoining roof plate member 10 from its lower end. When the first through the third projection boards are spanned between the right and the left joint members 14R and 14L or more specifically between the leg 14*a*1 of the joint member 14L and the leg 14*a*2 of the joint member 14R, the respective projection boards interfere with the fold 14*b*1 above the joint member 14R. The first through the third projection boards are accordingly designed to have a length that does not interfere with the fold 14*b*1. In this embodiment, the length of each projection board is set to have a gap of approximately 10 mm from the leg 14*a*2 of the joint member 14R.

The roof plate 10 has end projections 45 of L-shaped steel plates on the outer side of the fold 14*b*1 of the joint member 14L as shown in FIG. 4. The end projections 45 are used to fill the gaps between the first through the third projection boards and the leg 14*a*2, and are fixed by seamless welding. When the roof plate 10 is positioned as discussed later, the end projections 45 come into contact with or close to the first through the third projection boards to fill the gaps. For the secure blocking of the gaps, an elastic material, such as rubber, elastomer, or soft plastic, is preferably bonded as a sealing member to one face of the end projections 45 facing the respective projection boards.

The roof plates 10 of the above construction are longitudinally laid to shingle the roof, in such a manner that the leg 14*a*1 of the joint member 14L and the fold 14*b*2 of the adjoining joint member 14R engage and are coupled with each other and are located on the roof rafter N, as shown in FIG. 5. In the shingled roof 100, the joint members 14L form convexes protruded upward from the planar roof plate members 12 of the roof plates 10. The joint member 14L has the length identical with that of the roof plate member 12, and runs from the ridge to be extended from the pole plate NB along the pitch of the roof. As illustrated, a plurality of the joint members 14L are arranged along the roof width.

In this embodiment, the multiple roof plates 10 are longitudinally laid for roofing as discussed above. A roof plate 10A is used at the gable end of the roof for the better roofing appearance. As shown in FIGS. 2 and 6, this roof plate 10A is located at the right gable end of the roofing assembly 110L. The roof plate 10A has a hollow rectangular auxiliary fixation member 17, which is located on the roof rafter N at the gable end, in addition to the joint member 14L including the leg 14*a*1 and the fold 14*b*1 and the fixation member 16. The roof plate 10A further has a shielding member 18 that covers the gable end of the roof rafter N, a shielding lower end member 19 that holds the roof rafter N, and an end convex body 15 protruded upward to the same height as that of the joint member 14L. A roof plate having a symmetrical structure to that of the roof plate 10A is used at the left gable end of the roof.

While the roof plate 10 has the fixed width X, the roof plate 10A has a varying width X0. A roof width YX between the two gable ends of the roof is diversely varied. The varying width X0 of the roof plate 10A is individually determined for each roof of interest to be shingled, based on the roof width YX and the fixed width X of the roof plate 10.

The roofing assembly 110R also uses the roof plates 10 and 10A and has a similar structure to that of the roofing assembly 110L, except the shingling orientation of the roof.

Figure 7:
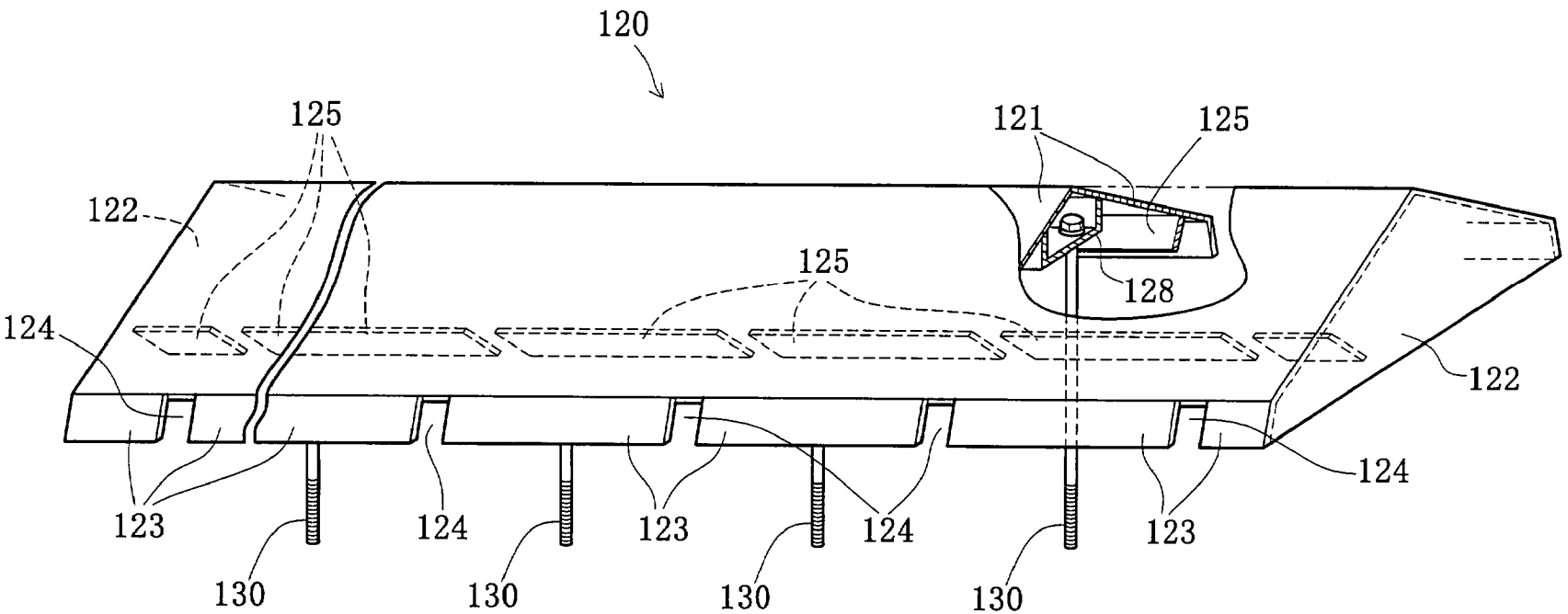
FIG. 7 is a partly broken perspective view schematically illustrating a ridge capping 120.
Figure 8:
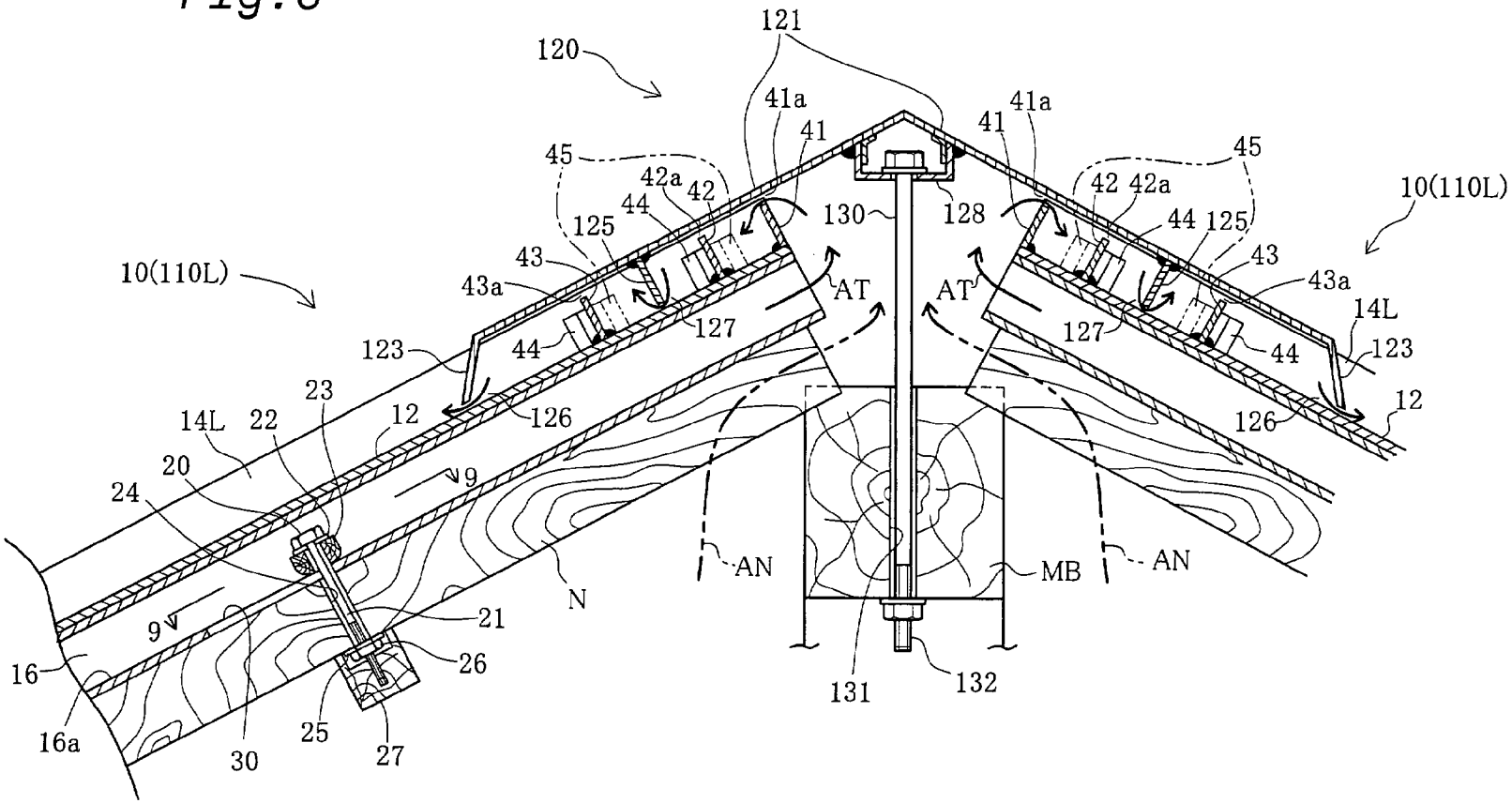
FIG. 8 shows fixation of the ridge capping 120 and the roof plate 10, as well as the positional relationship between the ridge capping 120 and the roof plate 10.
Figure 9:
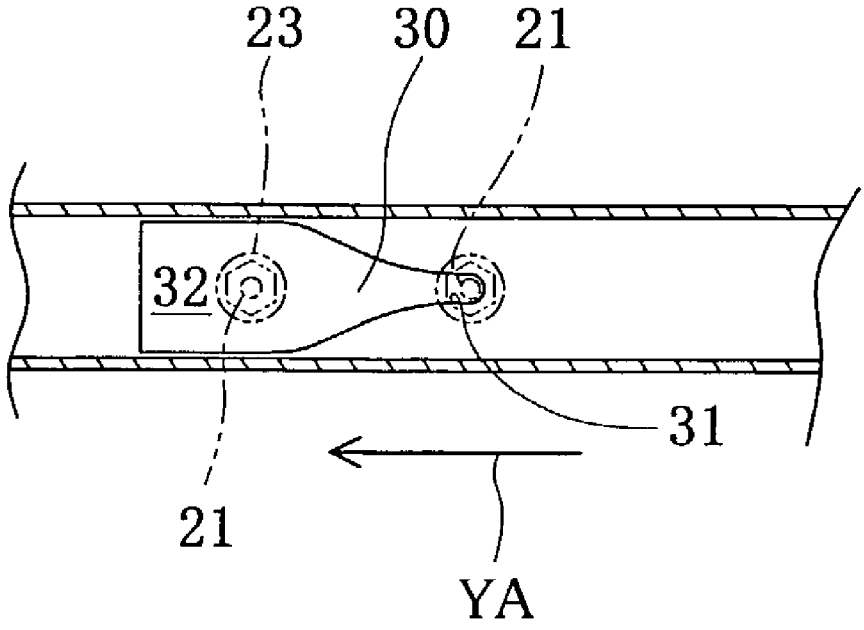
FIG. 9 is a sectional view taken on a line 9—9 in FIG. 8.

The ridge capping 120 is discussed below. FIG. 7 is a partly broken perspective view schematically illustrating the ridge capping 120. FIG. 8 shows fixation of the ridge capping 120 and the roof plate 10, as well as the positional relationship between the ridge capping 120 and the roof plate 10. FIG. 9 is a sectional view taken on a line 9—9 in FIG. 8.

The ridge capping 120 forms the ridge appearance of the roof as mentioned previously, and includes inclined ridge plates 121 arranged at a specific angle suitable for the pitch of the roof. Both ends of the inclined ridge plates 121 (that is, the gable ends of the roof) are covered by gable end shielding plates 122. In the ridge capping 120, the inclined end of each inclined ridge plate 121 is bent to form multiple skirt elements 123 with notches 124 therebetween. The notches 124 are formed in accordance with the pitch of the joint members 14L in the roofing assemblies 110L and 110R of the shingled roof. Namely each of the skirt elements 123 parted by the notches 124 is inserted into the space between the adjoining pair of the joint members 14L in the shingled roof. The ridge capping 120 also has rear projection plates 125, which have practically the same length as that of the skirt element 123 and are arrayed to face the skirt elements 123 on the rear face of each inclined ridge plate 121. The rear projection plates 125 are fixed with non-illustrated reinforcing members by an adequate technique like seamless welding. The protrusion lengths of the skirt element 123 and the rear projection plate 125 are adjusted to form gaps 126 and 127 between the respective ends and the upper face of the roof plate member 12 of the roof plate 10.

The ridge capping 120 has U-shaped, steel bolt support members 128 disposed on the rear face of its peak. Each of the bolt support members 128 supports a long bolt 130 of a specific length penetrating the ridgepole MB. The bolt support member 128 is fixed with reinforcing members 129 by an appropriate technique like seamless welding. A sufficient number of the bolt support members 128 and the long bolts 130 for straining and fixing the ridge capping 120 toward the ridgepole MB are provided along the longitudinal axis of the ridge capping 120 (see FIG. 7).

The following describes fixation of the roof plate 10 and the ridge capping 120.

As shown in FIGS. 2, 3, and 5, the roof plates 10 are arranged on the roof frame YH along the pitch of the roof, in such a manner that the fixation members 16 are laid on the roof rafters N. The fixation member 16 has fixation holes 30 formed in its bottom element 16*a*, which is in contact with the upper face of the roof rafter N. Each fixation hole 30 receives a shaft 21 of a bolt member 20 projected from the roof rafter N as shown in FIGS. 8 and 9. The fixation holes 40 are formed in the fixation member 16 at predetermined pitches. The bolt members 20 penetrating the roof rafter N and a sheathing roof board Nj are arranged in accordance with the predetermined pitch. Each of the fixation holes 30 includes a small-diametral aperture section 31 that has a width substantially equal to the diameter of the shaft 21, and a wide slot section 32 that is wider than the bolt head of the bolt member 20 as well as the diameter of a spherical washer 23. The small-diametral aperture section 31 is located above the wide slot section 32 along the pitch of the roof. The width of the fixation hole 30 is gradually narrowed from the wide slot section 32 to the small-diametral aperture section 31. The small-diametral aperture section 31 has the width substantially equal to the diameter of the shaft 21 and receives the shaft 21 therein, thus functioning as a positioning element relative to the shaft 21 and the whole bolt member 20.

The bolt members 20 are attached to the roof rafter N, prior to shingling the roof with the roof plates 10. Each of the bolt members 20 with a split washer 22 and the spherical washer 23 located close to the bolt head is inserted into a through hole 24 of the roof rafter N. A nut 26 is screwed from the rear side of the roof rafter N on the male threaded part of the shaft 21 via a flat washer 25. The screwed nut allows the bolt member 20 to be vertically movable by a distance exceeding a thickness t of the bottom element 16*a*.

After attachment of the bolt members 20, the roof plate 10 is located above the roof rafter N to make the wide slot section 32 of each fixation hole 30 overlap the bolt head of the bolt member 20 projected from the roof rafter N. In this state, the roof plate 10 is let down to be placed on the roof rafter N. The bolt member 20 with the split washer 22 and the spherical washer 23 then enters the wide slot section 32. The roof plate 10 is subsequently shifted downward along the pitch of the roof as shown by an arrow YA. The downward shift causes the shaft 21 of the bolt member 20 in the wide slot section 32 to move into the small-diametral aperture section 31 of the fixation hole 30 and to be positioned by the small-diametral aperture section 31. In the course of the shift of the roof plate, the lower sphere of the spherical washer 23 comes into contact with the surrounding wall of the small-diametral aperture section 31 and the upper face of the bottom element 16*a*. The vertical movement of the bolt member 20 enables the shaft 21 to enter the small-diametral aperture section 31 without any difficulties. The roof plate member 12 or the roof plate 10 is thus positioned relative to the roof rafter N. Fixation holes may be formed for the auxiliary fixation member 17 of the roof plate 10A, in the same manner as the fixation holes 30 for the fixation member 16.

The nut 26 is then screwed from the rear side of the roof rafter to strain the bolt member 20 toward the roof rafter, so that the bolt member 20 fastens the fixation member 16 and thereby the roof plate 10. This completes shingling of the roof with the inclined roof planes, and makes the roofing assemblies 110L and 110R fixed to the roof frame YH. Even when each of the roof plates 10 in the shingled roof is exposed to a lifting force due to a high gale, fixation with the bolt members 20 effectively prevents the lift of the roof plates 10.

After completion of shingling of the roof with the inclined roof planes, a wooden cap nut 27 having a female screw hole and a concentric bottomed hole is screwed to the threaded end of the shaft 21.

The roof plates 10 are successively laid for roofing, and the adjoining roof plates 10 are joined with each other by means of the joint members 14 as described previously. No mechanical binding, such as screwing or welding, is required for the joint.

The ridge capping 120 is attached after the shingling of the roof with the roof plates 10 to form the inclined roof planes. The ridge capping 120 is first lifted to the ridge of the roof frame YH with the roofing assemblies 110L and 110R fixed thereto, and is positioned to cover the ridgepole MB. The positioning should be carried out to make the notches 124 overlap the joint members 14L of the roof plates 10 and to make the skirt elements 123 located between the adjoining joint members 14L. The ridge capping 120 is then fallen down onto the ridgepole MB. The above positioning of the notches 124 and the skirt elements 123 enables the long bolts 130 to enter through holes 131 of the ridgepole MB.

As shown in FIG. 8, the skirt elements 123 and the rear projection plates 125 projected from the lower face of the ridge capping 120 are then respectively arranged between the adjoining joint members 14L to form a lower horizontal array and an upper horizontal array along the pitch of the roof. The third projection boards 43 protruded from the upper face of the roof plate members 12 of the roof plates 10 are interposed between the horizontal arrays of the skirt elements 123 and the rear projection plates 125 along the pitch of the roof. Each pair of the adjoining joint members 14L define a rectangular recess therebetween, while the skirt element 123 and the rear projection plate 125 are both rectangular as shown in FIGS. 2 and 8. The skirt element 123 and the rear projection plate 125 extended from the rear face of the ridge capping 120 are accordingly fitted in the recess defined by the adjoining joint members 14L, and block the recess via the gaps 126 and 127. The third projection board 43 protruded from the upper face of the roof plate member 12 and interposed between the skirt element 123 and the rear projection plate 125 blocks, in cooperation with the end projection 45 (see FIG. 4), the recess via a gap 43*a* on the rear face side of the ridge capping 120. In the space defined by the lower face of the ridge capping 120 and the upper face of the roofing assemblies 110L and 110R, the skirt elements 123 protruded from the lower face of the ridge capping 120, the third projection boards 43 protruded from the upper face of the roof plate members 12, and the rear projection plates 125 protruded from the lower face of the ridge capping 120 are arranged to face one another in this sequence from the pole plate side to the ridge side to form horizontal arrays along the pitch of the roof.

The first projection board 41 and the second projection board 42 are located above the rear projection plate 125 along the pitch of the roof. These projection boards 41 and 42 block, in cooperation with their end projections 45 (see FIG. 4), the recess via gaps 41*a* and 42*a* on the rear face side of the ridge capping 120.

The ridge capping 120 positioned in the above manner is propped up by the upper face of the multiple joint members 14L with the gaps 126, 127, and 41*a* through 43*a*. Nuts 132 are screwed and clamped on the lower face of the ridgepole MB to strain and fix the ridge capping 120 to the ridgepole MB. This completes the procedure of roofing.

The reverse procedure to the above roofing process should be performed for detachment, recovery, and relocation (recycle) of the assembled ridge capping 120 and roofing assemblies 110L and 110R (more specifically, roof plates 10). The procedure first removes all the nuts 132 from the bolts, lifts the ridge capping 120 up, and detaches the ridge capping 120 from the roof frame YH. The procedure then removes the wooden cap nuts 27, loosens the nuts 26, and shifts the respective roof plates 10 upward along the pitch of the roof, that is, in the reverse direction to the arrow YA. The upward shift causes each of the bolt members 20 and the spherical washers 23 to be located in the wide slot section 32. In this state, each of the roof plates 10 is lifted from the roof rafters N.

The roof 100 of the embodiment described above has the following advantages with regard to the procedure of roofing.

(1) Roofing is attained by the simple procedure, which locates the roof plates 10 on the roof rafters N and then shifts the roof plates 10. This facilitates the roofing procedure as well as the detachment and relocation procedure. No mechanical binding, such as screwing, is required for joint of the adjoining roof plates 10. This further facilitates the roofing procedure.

(2) The spherical washers 23 are used for fixation of the roof plate 10 with the bolt members 20. The fixation hole 30 is designed to prevent the spherical washer 23 from interfering with the circumferential wall of the fixation hole 30 in the process of shifting the roof plate 10 along the pitch of the roof. Such design ensures smooth shift of the roof plates 10 and facilitates the whole roofing procedure.

(3) After shingling the roof with the roof plates 10 on both sides, the ridge capping 120 is lifted up to the ridge and is clamped and fixed with the long bolts 130 and nuts 132. Attachment and detachment of the ridge capping 120 are implemented by simple clamping and loosening of the bolts and nuts. The ridge capping 120 is strained and fixed to the ridgepole MB by means of the long bolts 130. This arrangement allows the work of attachment and detachment of the ridge capping 120 to be performed from the lower face of the ridgepole MB, thus further facilitating the fixation and detachment of the ridge capping 120.

The following describes the rainfall measures of the roof 100 of the embodiment.

Rainwater falling down on the ridge of the roof flows down along the inclined ridge plates 121 of the ridge capping 120 to reach the roofing assemblies 110L and 110R in a non-covered area without the ridge capping 120. The flown-down rainwater runs together with rainwater directly falling down on the roofing assemblies 110L and 110R along the pitch of the roof towards the pole plates. The substantially straight rainfall without gale does not run upward on the roof plate members 12 toward the ridge against the pitch of the roof. The arrangement of leading the rainwater from the ridge capping 120 to the roofing assemblies 110L and 110R thus ensures the effective measure against such rainfall without gale.

The rainfall with gale as in the case of a typhoon (rainstorm), on the other hand, may run upward on the roof plate members 12 toward the ridge against the pitch of the roof. The upward flow of the rainwater is mostly blocked by the skirt elements 123 of the ridge capping 120, and only a small portion of the rain flow passes through the gaps 126 on the lower end of the skirt elements 123 toward the ridge. The small portion of the rain flow passing through the gaps 126 is exposed to the gravity along the pitch of the roof and naturally falls down along the pitch of the roof. This structure thus effectively prevents substantially any portion of the rain flow passing through the gaps 126 from being kept upstream the skirt elements 123.

In the case of an extremely high gale, the strong wind significantly affects the upward flow of rainwater against the pitch of the roof. The rain flow may accordingly run towards the ridge even after passage through the gaps 126. The quantity of the rain flow running reversely to the ridge across the skirt elements 123 is reduced by the blockage of the skirt elements 123 and the function of gravity. The rain flow across the skirt elements 123 is blocked by the third projection boards 43 protruded from the upper face of the roof plate members 12 above the skirt elements 123.

In the actual state, it is practically impossible that the rain flow across the skirt elements 123 runs over the third projection boards 43 on the upper face of the roof plate members 12 toward the ridge. The rain flow can cross over the third projection boards 43, only when the rainwater kept below the third projection boards 43 has a sufficient volume to run over the upper end of the third projection boards 43. The quantity of upward rain flow toward the ridge is, however, reduced by the blockage of the skirt elements 123 and the function of gravity, as described above. There is accordingly very little volume of rainwater kept below the third projection boards 43. As clearly understood from FIG. 8, the greater distance between the skirt element 123 and the third projection board 43 lowers the possibility that the rainwater kept below the third projection board 43 has the sufficient volume to run over the upper end of the third projection bard 43. This arrangement thus effectively prevents the rain flow across the lower skirt elements 123 from running over the upper end of the third projection boards 43 above the skirt elements 123 along the pitch of the roof toward the ridge.

Above the third projection boards 43, the rear projection plate 125 and the second projection board 43 hold a similar positional relationship to that of the skirt element 123 and the third projection board 43. It is thus practically impossible that the rainwater runs over the upper end of the second projection board 42 toward the ridge. The skirt element 123 and the rear projection plate 125 protruded from the lower face of the ridge capping 120 are fitted in the recess defined by the adjoining joint members 14L and effectively block the recess. The third projection board 43 and the second projection board 42, in combination with the end projections 45, also effectively block the recess. This arrangement further prevents the rainwater from flowing up toward the ridge. Even in the case of heavy rain with gale, the ridge of this structure ensures the preferable rainfall measure.

This arrangement also attains the effective rainfall measure against the rainwater flowing down from the ridge capping 120 onto the roofing assemblies 110L and 110R and the rainwater directly falling down on the roofing assemblies 110L and 110R.

As shown in FIGS. 2 and 5, the joint members 14R and 14L of the adjoining roof plates 10 are not mechanically joined with each other, but there is a little gap therebetween. Practically no rainwater, however, enters this gap, and the roof rafters N located below the roof plates 10 are almost completely kept from the rainwater. The rainwater should reach the height H3 of the fold 14*b*1 of the left roof plate 10 to enter the gap formed by the combined joint members 14R and 14L. Even in the case of heavy rain to make a layer of rainwater on the roof plate members 12 of the roof plates 10, it is practically impossible that the layer of rainwater exceeds the height H3, since the roof plates 10 are inclined by a slope e, which is the pitch of the roof. Even if the rainwater exceeds the height H3 and enters the joint by any chance, the fold 14*b*2 of the right roof plate 10 functions as a gutter having the height H2 and the slope e to flow the rainwater down. In the arrangement of this embodiment, is H3<H2 (see FIG. 3). Even if the rainwater reaches the fold of the height H3, the gutter formed by the fold having the greater depth than the height H3 exerts the effective drainage function and prevents the rainwater from entering the sheathing roof boards.

The roof 100 of this embodiment has additional advantages 20 discussed below.

The skirt element 123 and the rear projection plate 125 of the ridge capping 120 respectively have the gaps 126 and 127 on the lower ends thereof. These gaps 126 and 127 function as air vents along the upper face of the roof plate member 127. The first projection board 41 through the third projection board 43 of the roof plate 10 also have the gaps 41*a* and 43*a* on the lower ends thereof to function as air vents. In the structure of this embodiment, the roof plates 10 are propped up by the hollow fixation members 16 on the roof rafters N disposed at preset intervals in the roof frame YH (see FIG. 1). The air in the hollow of the fixation members 16 and the air below the roof plates 10 are vented to the side of the ridgepole MB as shown by arrows AT and AN in FIG. 8. The air is discharged to the atmosphere via the gaps 41*a* through 43*a* and the gaps 126 and 127. This arrangement ensures the ventilation inside the building and under the roof via the ridge at the peak of the roof (that is, the area below the ridge capping 120), thus attaining the favorable residential environments. In the summer season with high sunbeams, the radiation from the sun heats up the whole roof during the daytime and heightens the temperature of the air in the hollow of the fixation members 16 and the air in the whole area below the roofing assemblies 110L and 110R and the ridge capping 120. During the night, the heated air is discharged and vented as shown by the arrows AT and AN in FIG. 8. This arrangement thus effectively prevents the inside of the building from being heated through the hot roof. No ventilating fan or any other fan consuming electrical energy is required for such prevention of heat. This arrangement is thus of energy saving.

The projection height of the joint member 14R from the lower face of the roof plate member 12 is identical with the height of the fixation member 16. The combination of the joint member 14R with the fixation member 16 props up the roof plate 10 above the roof rafter N. This arrangement effectively prevents warping or other deformation of the roof plate members.

Figure 10:
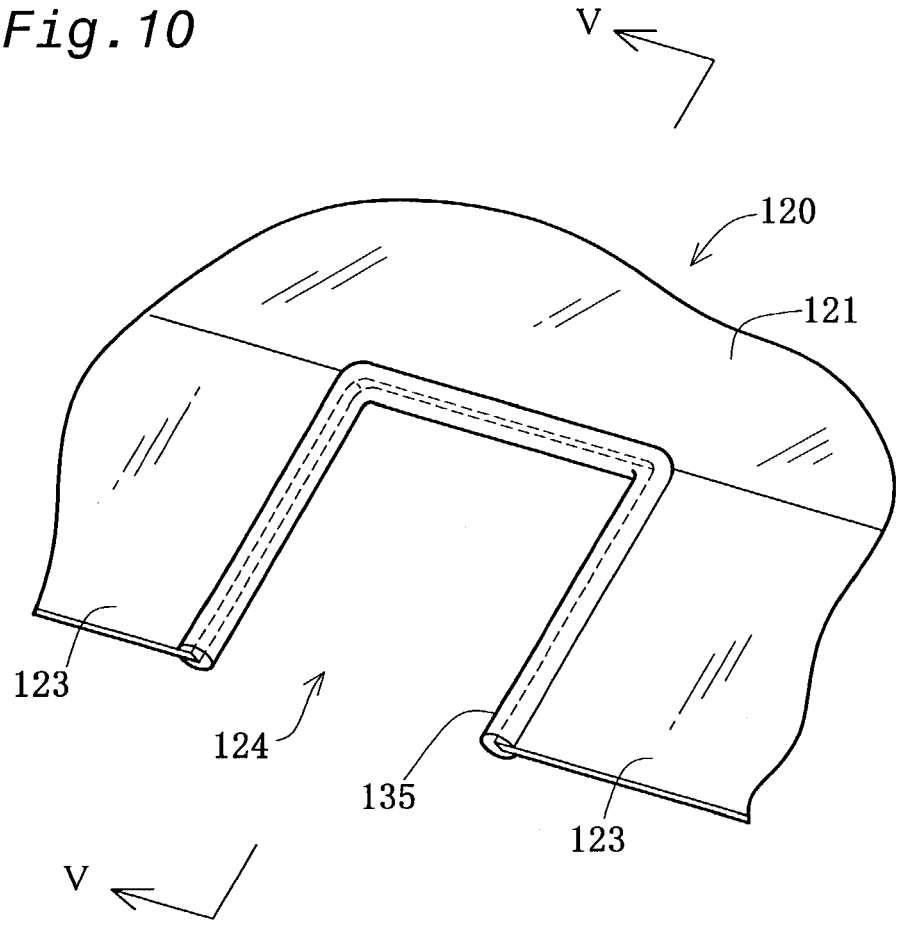
FIG. 10 shows a modified example of the ridge capping 120.
Figure 10:
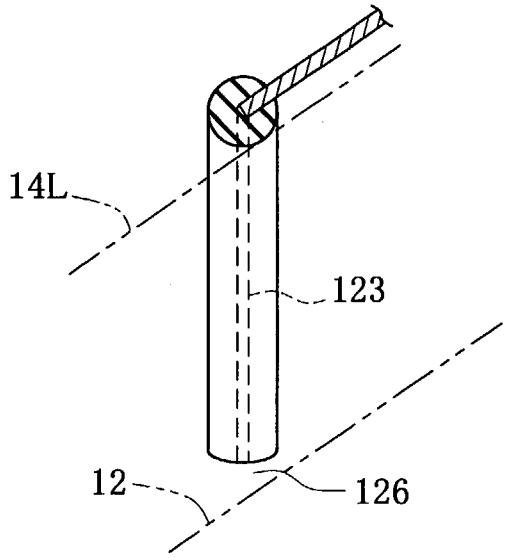

Some examples of possible modification are discussed below. FIG. 10 shows a modified example of the ridge capping 120.

The ridge capping 120 of the illustrated modified structure has an elastic material, such as rubber, elastomer, or soft plastic, as a sealing member 135 surrounding each notch 124. This structure ensures the following advantage.

The flow of rainwater against the pitch of the roof as described above may occur on the joint members 14L. The ridge capping 120 is supported by the joint members 14L, and there is a very narrow gap between the lower face of the ridge capping 120 and the upper face of the joint members 14L. Practically no rainwater accordingly runs over the joint members 14L against the pitch of the roof. In the case of a rain storm, such as a typhoon, however, the rainwater may flow over the joint members 14L. In the modified structure of the ridge capping 120, the sealing member 135 effectively prevents the rainwater from running over the joint members 14L.

There is another modification.

Figure 11:
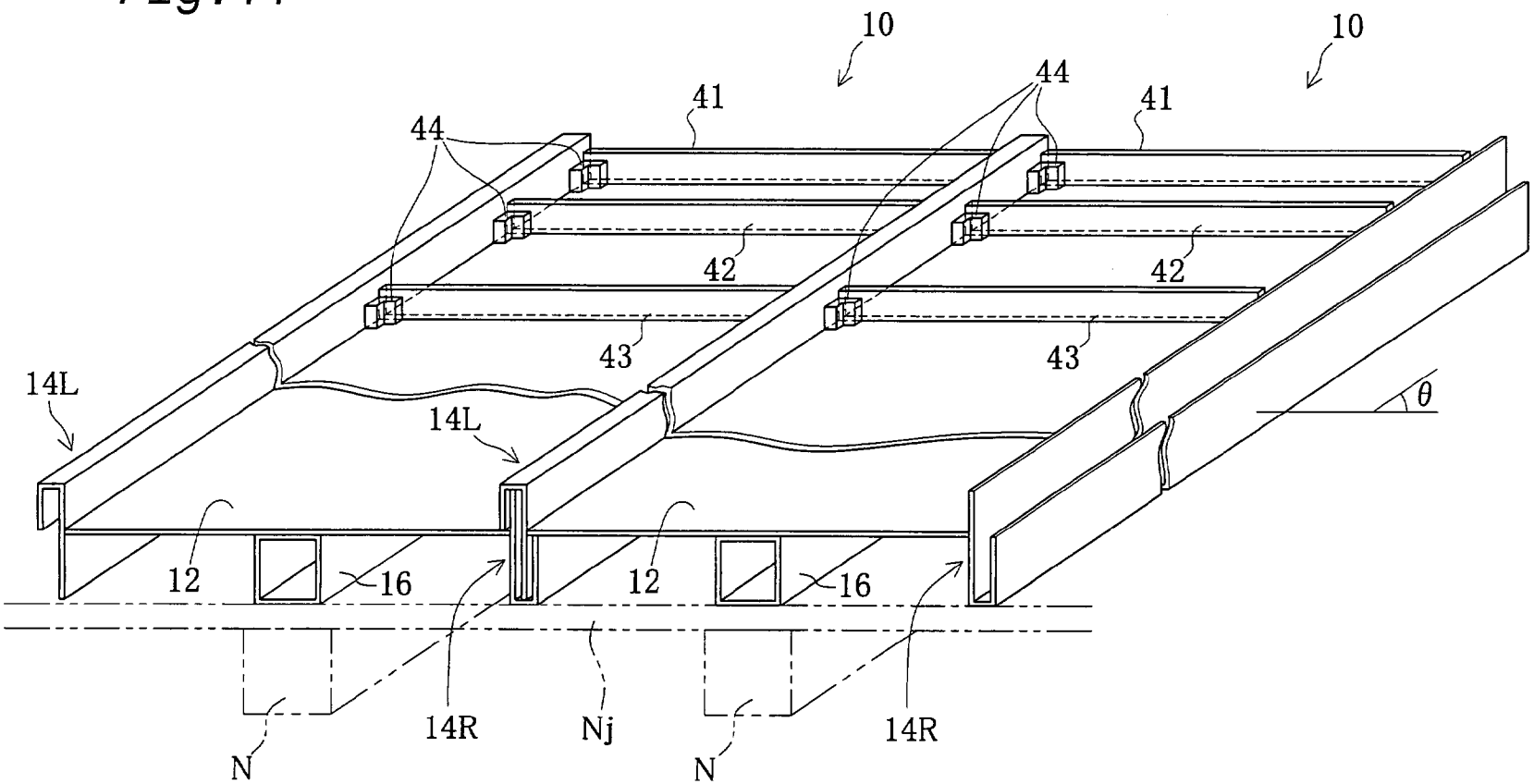
FIG. 11 is a perspective view schematically illustrating a modified example where the roof plates 10 are mounted on and fixed to sheathing roof boards Nj.
Figure 12:
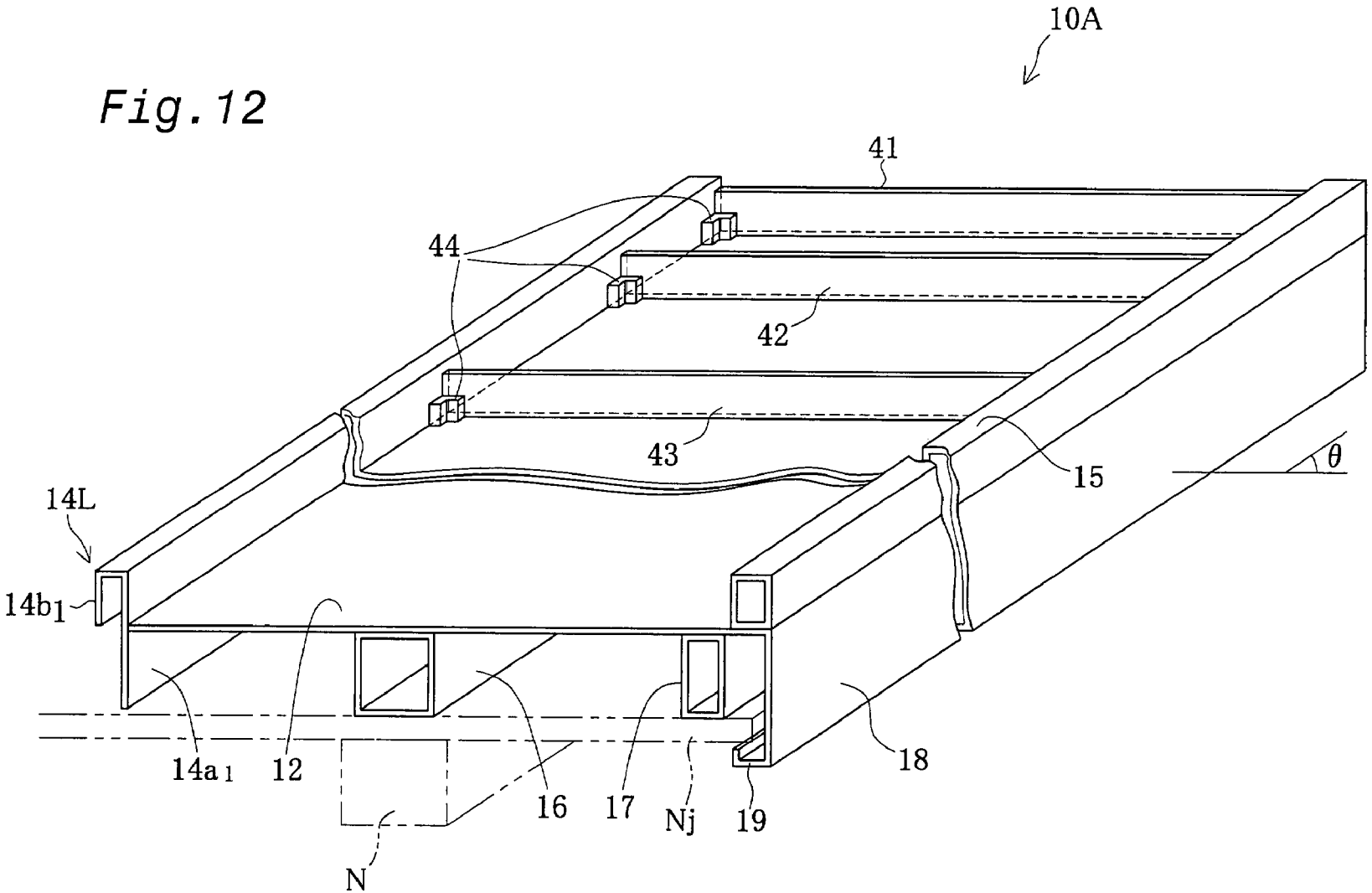
FIG. 12 is a perspective view showing the roof plate 10A on the gable side of the roof in this modified structure.

The joint members 14L and 14R prevent the rainwater from running below the roof plates 10. In the roof frame YH of one modified structure, the sheathing roof boards Nj are attached to the roof rafters N, and the roof plates 10 are fixed to the sheathing roof boards Nj. FIG. 11 is a perspective view schematically illustrating such a modified example where the roof plates 10 are mounted on and fixed to the sheathing roof boards Nj. FIG. 12 is a perspective view showing the roof plate 10A on the gable side of the roof in this modified structure.

As illustrated, there is no significant change in structure of the roof plates 10 in this modified structure where the roof plates 10 are mounted on the sheathing roof boards Nj. In the roof plate 10A on the gable side, the shielding member 18 should be suspended according to the size of the sheathing roof board Nj. In this modified structure, the bolt members 20 penetrating both the roof rafter N and the sheathing roof board Nj should be used for fixation of the roof plates.

In this modified structure, the roof plate members 12 are propped up by the hollow fixation members 16 to be apart from the sheathing roof boards Nj. The air layer including the hollow portions of the fixation members 16 is accordingly formed between the sheathing roof boards Nj and the roof plate members 12. The air layer effectively exerts the sound proof function against the pattering sound of raindrops and the heat insulating function against the temperature change of the roof plate members with the varying environment.

Another modification is described below.

Figure 13:
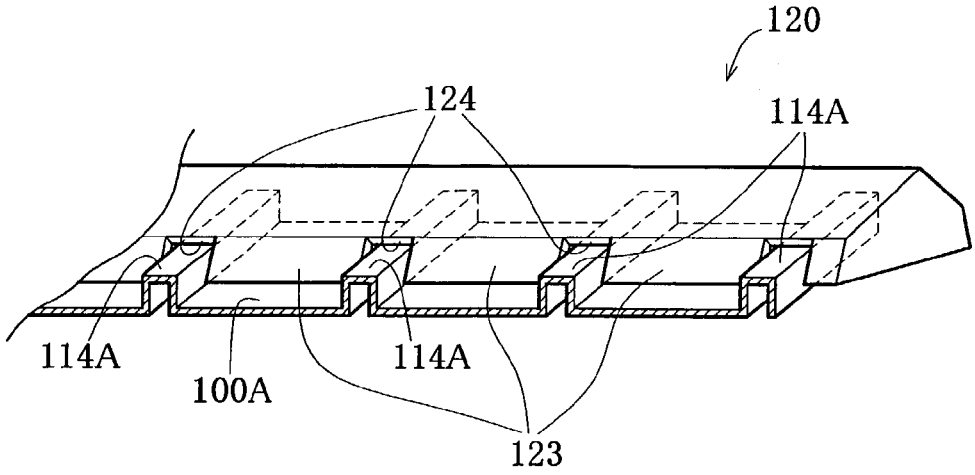
FIG. 13 shows another modified example, where a single-panel roof plate 100A is applied for the roofing assemblies 110L and 110R.
Figure 14:
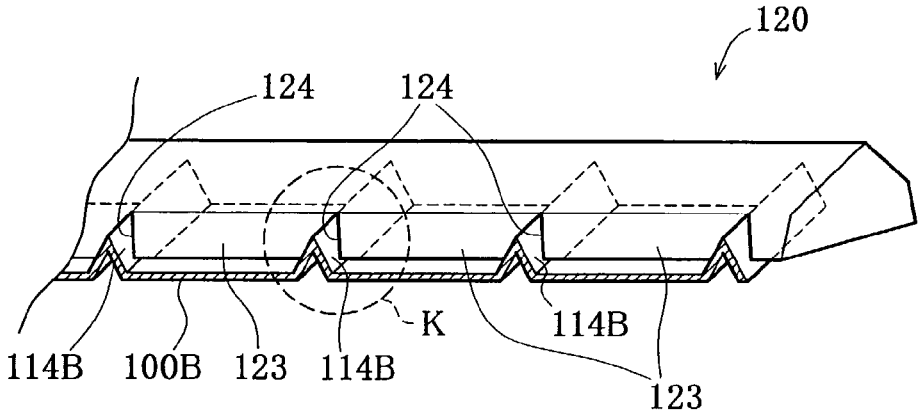
FIG. 14 shows still another modified example using another roof plate 100B.
Figure 14:
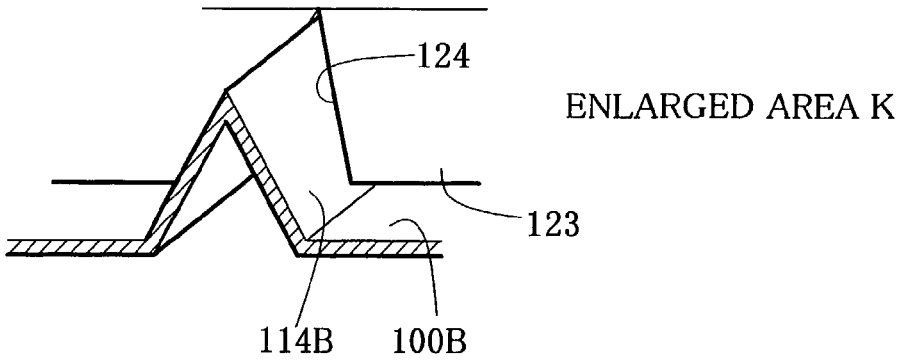
Figure 15:
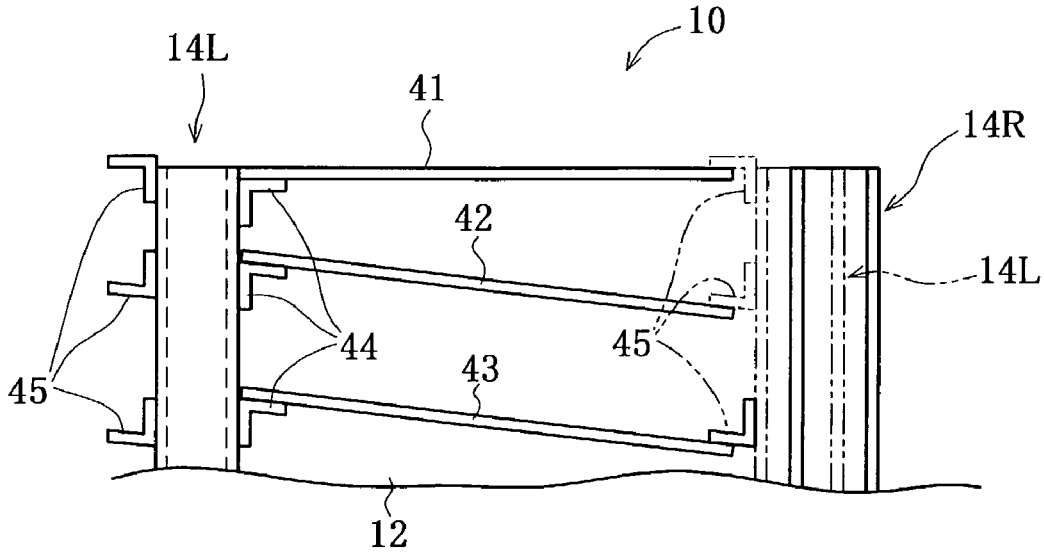
FIG. 15 shows a modified example of a second projection board 42 and a third projection board 43.

FIG. 13 shows another modified example, where a single-panel roof plate 100A is applied for the roofing assemblies 110L and 110R. FIG. 14 shows still another modified example using another roof plate 100B. FIG. 15 shows a modified example of the second projection board 42 and the third projection board 43.

As shown in FIG. 13, the roof plate 100A has a plurality of convexes 114A formed across the roof width. The convexes 114A function in place of the joint members 14L of the roof plates 10. In this modified example, the roof plate 100A is a single panel having the greater width than the area covered by the ridge capping 120. Non-illustrated flat roofing plates are laid in the horizontal direction on the downstream side along the pitch of the roof. As shown in FIG. 14, the roof plate 100B has a plurality of triangular convexes 114B, which function in place of the joint members 14L of the roof plates 10. The roof plate 100B has the following advantage.

When the upward flow of rainwater against the pitch of the roof enters the gaps defined by the contour face of the convexes 114B and the opening circumference of the triangular notches 124, the rainwater runs from the peak of each convex 114B along both slopes to reach the flat section on the upper face of the roof plate 100B and flows down on the flat section on the upper face of the roof plate 100B along the pitch of the roof. This arrangement effectively prevents the rainwater, which passes through the opening circumference of the notches 124, from flowing up against the pitch of the roof.

The second projection board 42 and the third projection board 43, which are protruded from and fixed to the upper face of the roof plate member 12, are inclined to have the lower right ends in the drawing of FIG. 15. The end projections 45 are arranged to ensure slight gaps on the inclined ends of the second and the third projection boards. Even if the flow of rainwater runs over the upper end of the third projection board 43 or the second projection board 42 and is blocked by the lower portion of the projection board, this arrangement desirably allows the rainwater to be flown down along the slope of the second or the third projection board.

Figure 16:
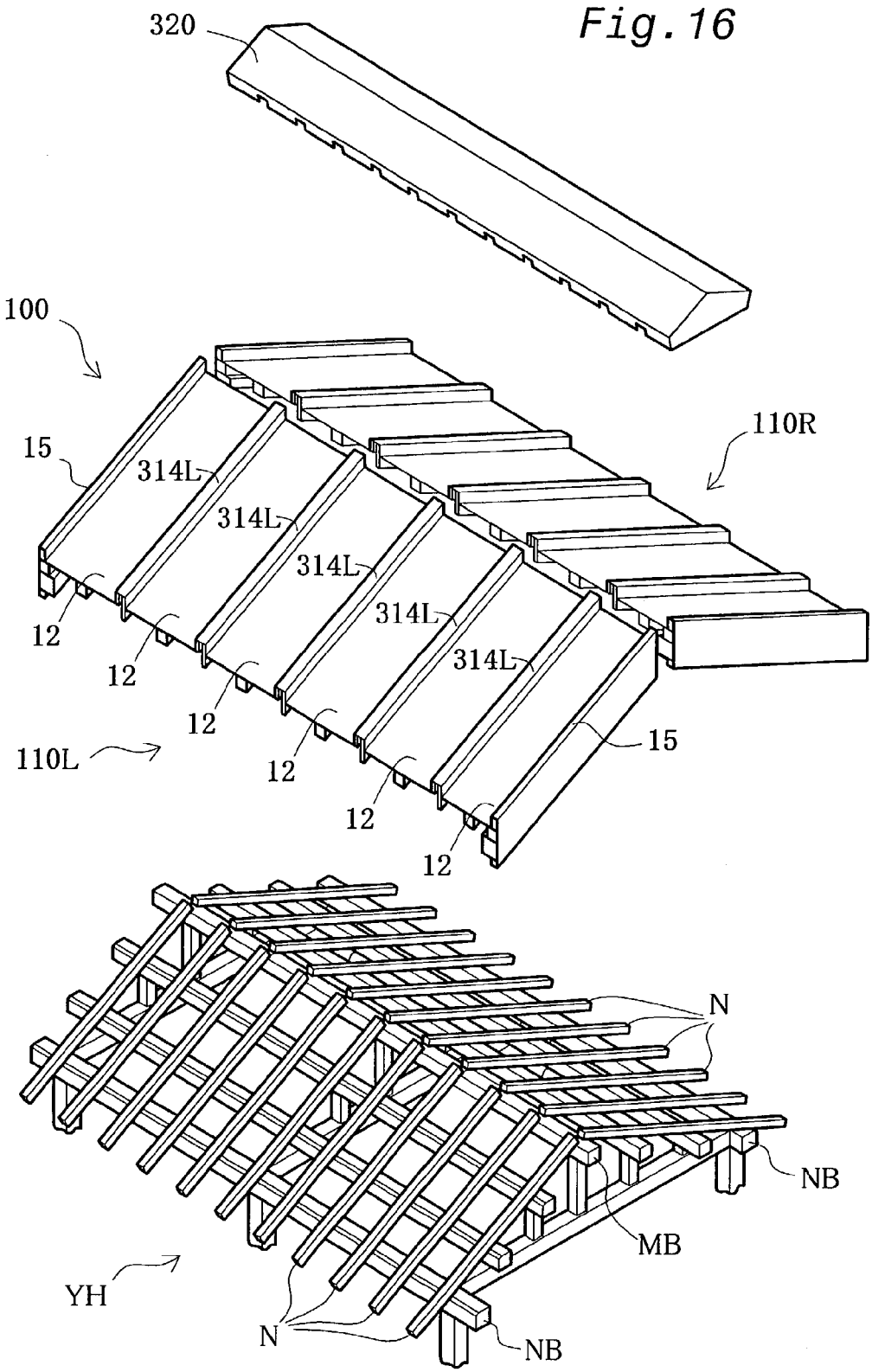
FIG. 16 schematically illustrates the general structure of a roof 100 in a second embodiment.
Figure 17:
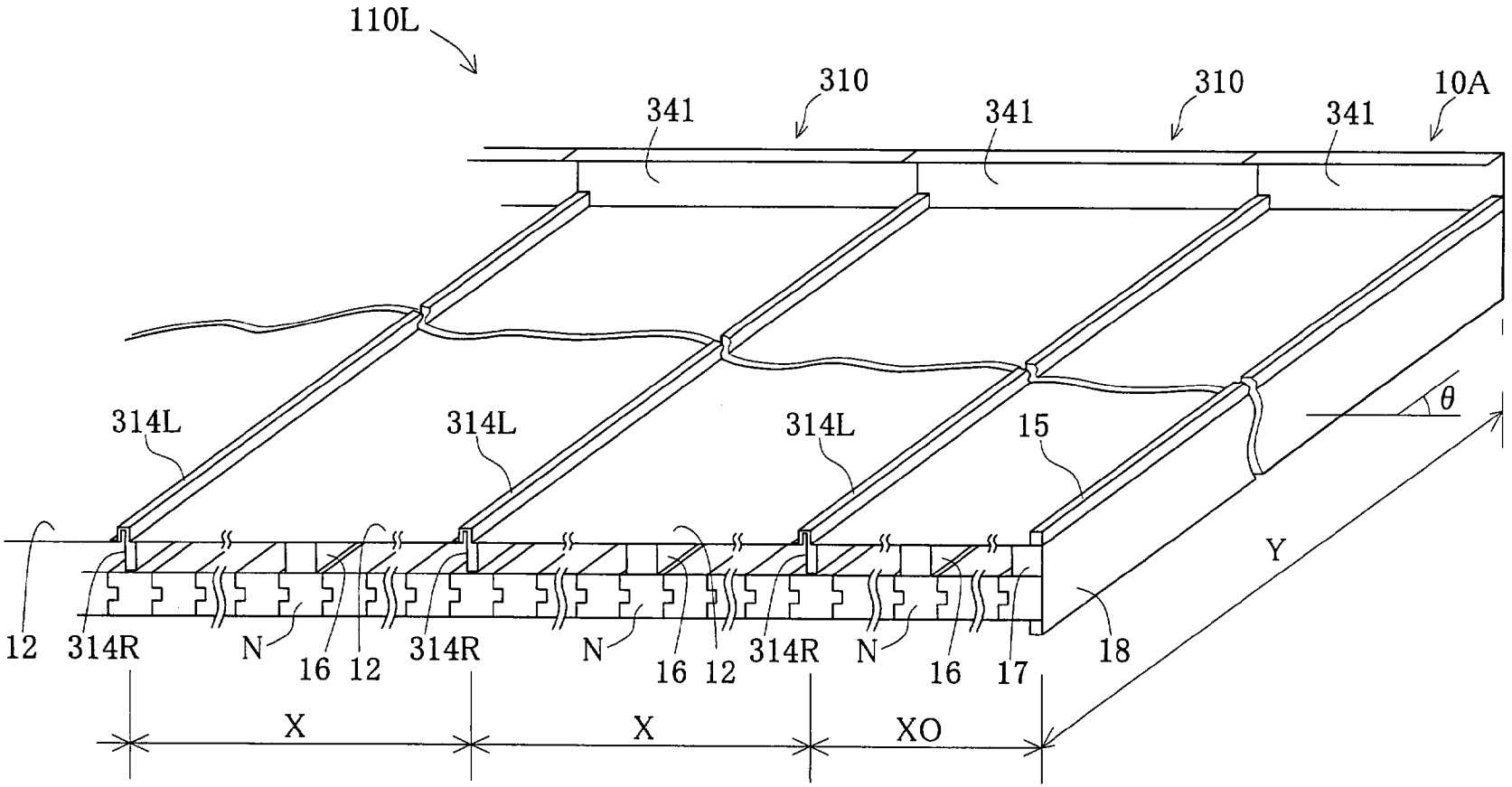
FIG. 17 shows a roofing assembly 110L including multiple roof plates 310 longitudinally laid to shingle a roof in the second embodiment.
Figure 18:
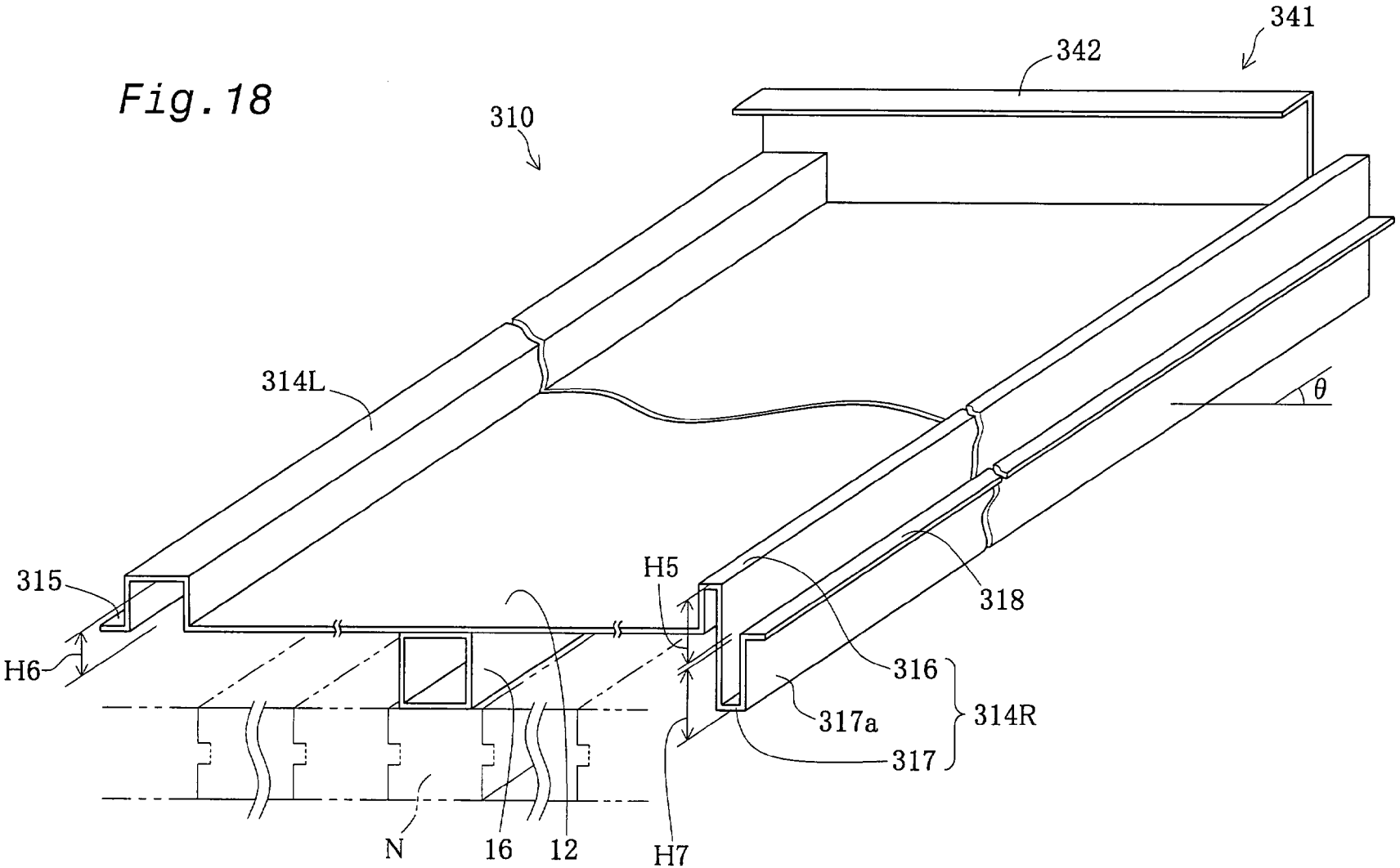
FIG. 18 is a perspective view schematically illustrating the roof plate 310.
Figure 19A:
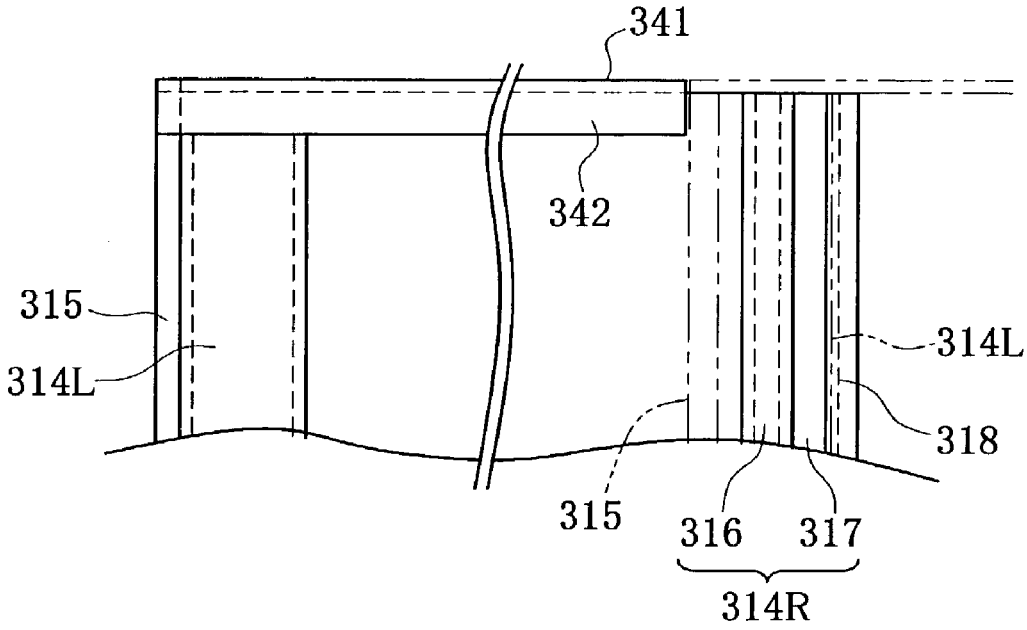
FIG. 19 shows a main part of the roof plate 310 seen from the top and from the front.
Figure 19B:
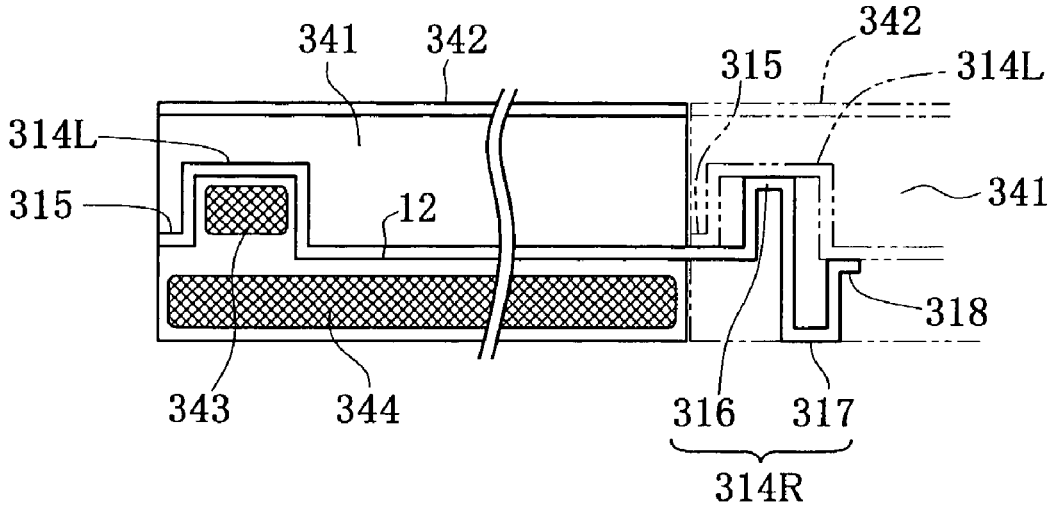
Figure 20:
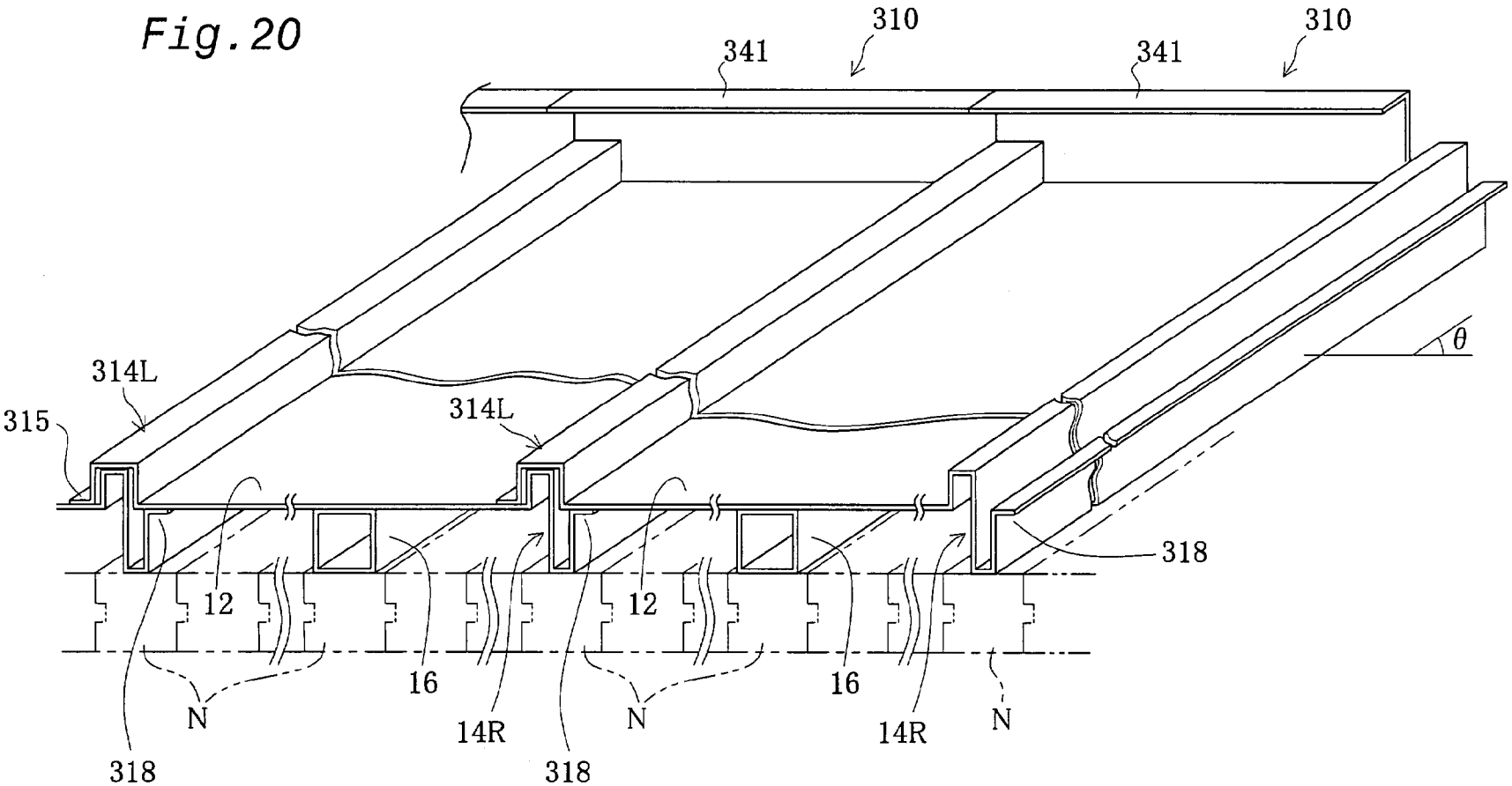
FIG. 20 is a perspective view illustrating joint of the roof plates 310.
Figure 21:
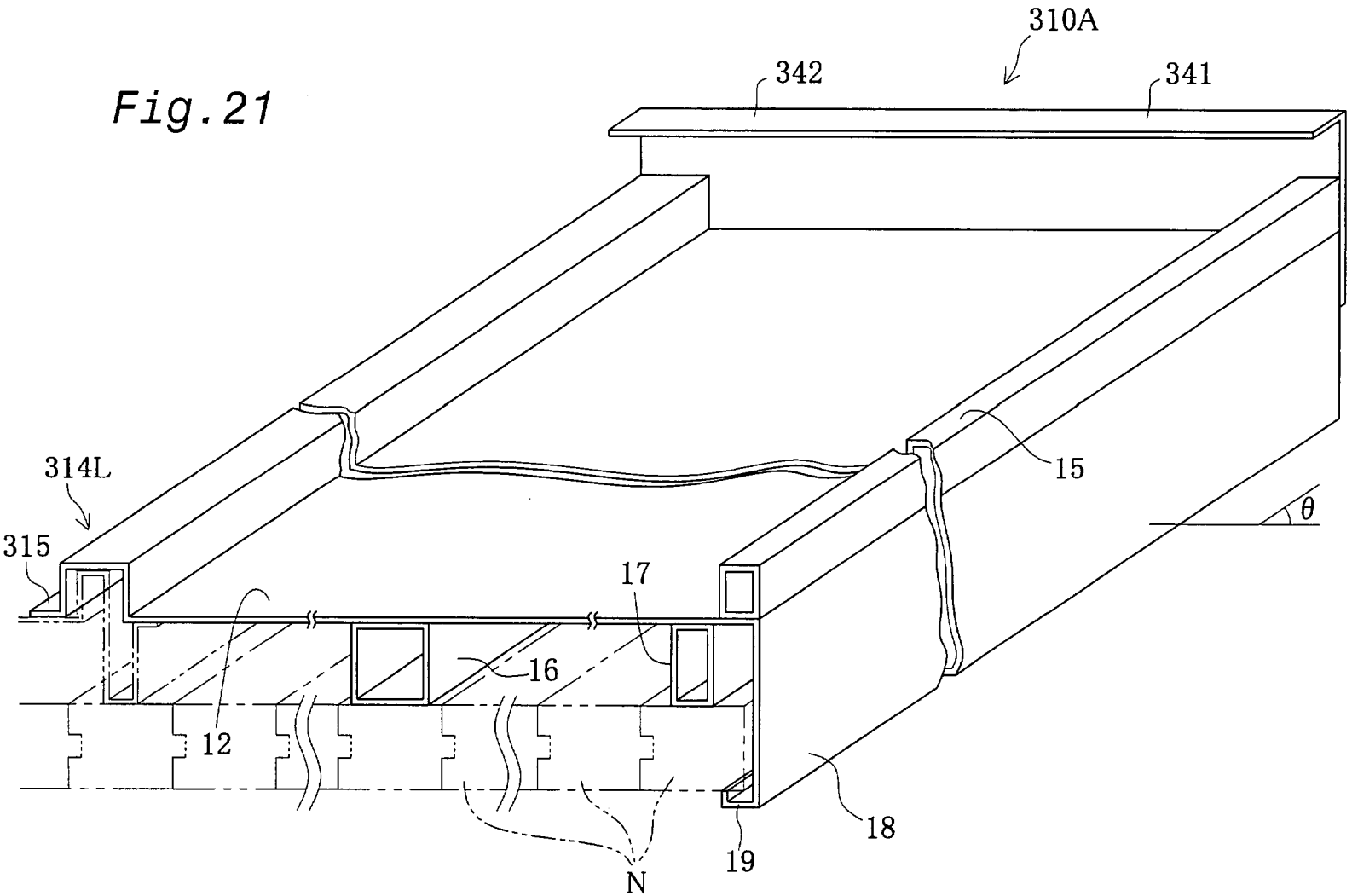
FIG. 21 is a perspective view schematically illustrating a roof plate 310A located on the gable end of the roof.

A second embodiment is discussed below. In the following description, the same elements as those of the first embodiment and the element having the equivalent functions to those of the first embodiment are shown by the like numerals and symbols used in the first embodiment. FIG. 16 schematically illustrates the general structure of a roof 100 in a second embodiment. FIG. 17 shows a roofing assembly 110L including multiple roof plates 310 longitudinally laid to shingle a roof in the second embodiment. FIG. 18 is a perspective view schematically illustrating the roof plate 310. FIG. 19 shows a main part of the roof plate 310 seen from the top and from the front. FIG. 20 is a perspective view illustrating joint of the roof plates 310. FIG. 21 is a perspective view schematically illustrating a roof plate 310A located on the gable end of the roof. A roofing assembly 110R in the second embodiment is also identical with the roofing assembly 110L with only difference in orientation of shingling.

As illustrated in these drawings, like the first embodiment, the roof 100 of the second embodiment has a gabled roof frame YH, left and right roofing assemblies 110L and 110R attached on both sides of the ridge of this roof frame YH with a predetermined pitch of roof, and a ridge capping 320 that covers the roofing assemblies 110L and 110R on both the sides of the roof at the ridge. The roof plate 310, which is the module unit of each roofing assembly, has right and left joint members 314R and 314L on the longitudinal sides of the long roof plate member 12. The fixation member 16 fixed to the roof rafter N is located on the center of the roof plate member 12. Although the roof rafters are shown at some intervals in the illustration of FIG. 16, the roof rafters N of the second embodiment are closely arranged without any spaces therebetween in the roof frame YH as shown in FIG. 17 and the subsequent drawings. The arrangement of the second embodiment may, however, be applicable to a modified roof frame including the roof rafters arranged at some intervals and sheathing roof boards laid on the upper face of the roof rafters.

The left joint member 314L is a convex section formed by bending the left end of the roof plate member 12 upward to a convex, and has a flange 315 on the outer edge thereof. The flange 315 is designed to overlap the upper face of the adjoining roof plate member 12 in the longitudinal direction. The thickness of this flange should be considered in the process of bending the outer edge of the joint member 314L.

The adjoining roof plate members 12 should substantially have the same height after the flange 315 is laid upon the roof plate member 12.

The right joint member 314R has an inner upward convex 316 to be fitted in the joint member 314L (convex section) of the adjoining roof plate 310, and a lower downward convex 317 connecting with the inner convex 316. A flange 318 is formed on the outer edge of the lower convex 317. The inner convex 316, the lower convex 317, and the flange 318 are formed by bending, in the same manner as the joint member 314L. The inner convex 316 is bent in such a manner that the top face of the upper end of the inner convex 316 overlaps the bottom face of the upper end of the joint member 314L. The inner convex 316 is designed, by taking into account the thickness of the plate, to have a projection height H5 (that is, the height H5 between the upper face of the roof plate member 12 and the top face of the upper end of the inner convex 316) substantially equal to a height H6 between the upper face of the roof plate member 12 and the bottom face of the upper end of the joint member 314L. A rising side end 317*a* defining the lower convex 317 is formed upright close to the lower face of the adjoining roof plate member 12, and the flange 318 extended from the rising side end 317*a* is designed to overlap the lower face of the adjoining roof plate member 12 in the longitudinal direction. Namely the thickness of the plate is considered in the process of bending the rising side end 317*a* and the flange 318 of the joint member 314R. The adjoining roof plate members 12 should have substantially the same height when the roof plate member 12 is laid upon the flange 318.

The outer dimension of the fixation member 16 is designed to be substantially equal to a projection height H7 of the lower convex 317 of the joint member 314R (that is, the height H7 between the lower face of the roof plate member 12 and the outer face of the lower end of the lower convex 317). The fixation member 16, in combination with the lower convexes 317 of the joint members 314R on both sides, props up the roof plate member 12 apart from the roof rafter N.

The roof plates 310 of the second embodiment having preset width X and length Y are manufactured, processed, and brought into the field for roofing. The height H6 and the width of the joint member 314L and the depth of the groove defined by the lower convex 317 of the joint member 314R are specified as discussed above. In the second embodiment, X is about 900 mm, Y is about 4000 mm, the projection height H6 of the joint member 314L is about 60 mm, and the depth of the groove in the joint member 314R is about 95 mm. The projection height H5 of the inner convex 316 of the joint member 314R is approximately 55 mm. There is a little gap formed between the joint member 314R and the inner convex 316 fitted therein. When the thickness of each plate is approximately 5 mm, the inner convex 316 is fitted in the joint member 314L to bring the top face of the inner convex 316 into contact with the lower face of the convex section of the joint member 314L. The lower convex 317 of the joint member 314R, which is in contact with the roof rafter N should have a dimension that prevents the lower convex 317 from biting into the roof rafter N and ranges from 15 mm to 45 mm. In this embodiment, the dimension of the lower convex 317 is 30 mm. The convex width of the joint member 314L is designed to have an inside dimension of about 70 mm, in order to cover over the inner convex 316 fitted therein and the lower convex 317 connecting with the inner convex 316. The materials discussed in the first embodiment are applicable for these elements. Metal plates suitable for bending are preferably used.

The roof plate 310 of the second embodiment has a projection board 341 on the ridge-side end of the roof plate member 12. The projection board 341 is designed to have the lower end at the same level as that of the lower faces of the fixation member 16 and the lower convex 317. The upper end of the projection board 341 is protruded to be higher than the joint member 314L and to be close to the lower face of an inclined ridge plate 321 of the ridge capping 320 discussed later with reference to FIG. 23. In this embodiment, the joint member 314L is protruded from the upper face of the roof plate member 12 by approximately 60 mm, and the projection board 341 is protruded by approximately 120 mm. This projection board 341 is attached to the ridge-side end of the roof plate member 12 by seamless welding, and the joint is reinforced by, for example, non-illustrated L-shaped steel plates.

The projection board 341 has a flange 342 on its upper end, which is bent to be substantially in parallel with the roof plate member 12. The length of the flange 342 is specified as discussed below.

In the arrangement of the roof plates 310 for roofing, as shown in FIGS. 17 and 20, the joint member 314R of one roof plate member 310 is inserted upward into the joint member 314L of an adjoining roof plate member 310 from its lower end. The dimension of the projection board 341 is adjusted to prevent interference of the combined members as discussed in the first embodiment. In this embodiment, the dimension of the projection board 341 is specified to ensure a gap of approximately 5 mm from the end face of the flange 315 of the adjoining joint member 314L. It is preferable that an elastic material, such as rubber, elastomer, or soft plastic is bonded to the gap as a sealing member.

The projection board 341 is fixed to the ridge-side end of the roof plate member 12. In the shingled state of the roofing assemblies 110R and 110L, the projection board 341 blocks the inner space of the joint member 314L and the gap (space) defined by the lower face of the roof plate member 12 and the upper face of the roof rafter N on the ridge side as shown in FIG. 19(*b*). The projection board 341 has nets 343 and 344 having the sizes (shapes) corresponding to the blocked spaces. The nets 343 and 344 ensure ventilation of the spaces and prevent invasion of small animals like rats and insects from the ridge side.

The roof plates 310 of the above construction are connected in such a manner that the inner convex 316 of one roof plate 310 is fitted in the joint member 314L of the adjoining roof plate 310, and are located on the roof rafters N to longitudinally shingle the roof, as shown in FIG. 20. In the shingled roof 100, the joint members 314L form convexes protruded upward from the planar roof plate members 12 of the roof plates 310. The joint member 314L has the length identical with that of the roof plate member 12, and runs from the ridge to be extended from the pole plate NB along the pitch of the roof. As illustrated, a plurality of the joint members 314L are arranged along the roof width.

In this embodiment, the multiple roof plates 310 are longitudinally laid for roofing as discussed above. A roof plate 310A is used at the gable end of the roof for the better roofing appearance. As shown in FIGS. 17 and 20, this roof plate 310A is located at the right gable end of the roofing assembly 110L. The roof plate 310A has a hollow rectangular auxiliary fixation member 17, which is located on the roof rafter N at the gable end, in addition to the joint member 314L including the flange 315 and the fixation member 16. The roof plate 310A further has a shielding member 18 that covers the gable end of the roof rafter N, a shielding lower end member 19 that holds the roof rafter N, and an end convex body 15 protruded upward to the same height as that of the joint member 314L. A roof plate having a symmetrical structure to that of the roof plate 310A is used at the left gable end of the roof.

While the roof plate 310 has the fixed width X, the roof plate 310A has a varying width X0. A roof width YX between the two gable ends of the roof is diversely varied. The varying width X0 of the roof plate 310A is individually determined for each roof of interest to be shingled, based on the roof width YX and the fixed width X of the roof plate 310.

The roofing assembly 110R also uses the roof plates 310 and 310A and has a similar structure to that of the roofing assembly 110L, except the shingling orientation of the roof.

Figure 22:
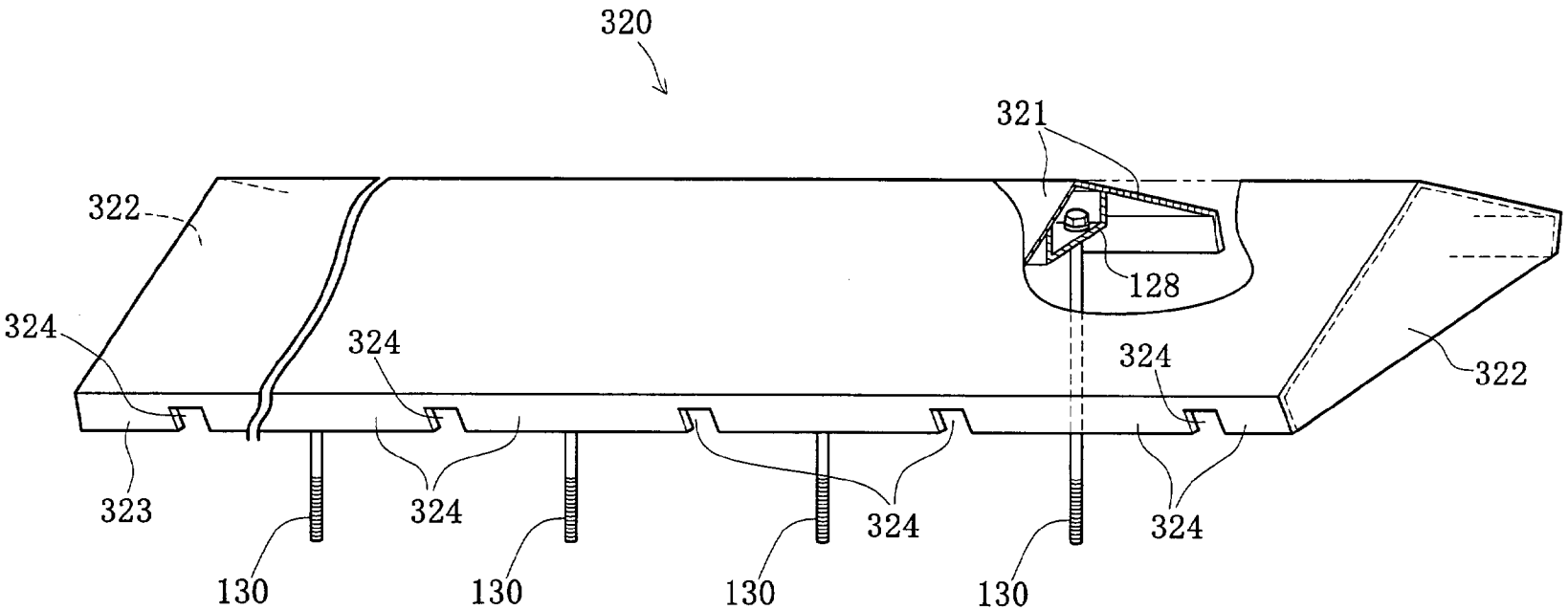
FIG. 22 is a partly broken perspective view schematically illustrating the ridge capping 320 of the second embodiment.
Figure 23:
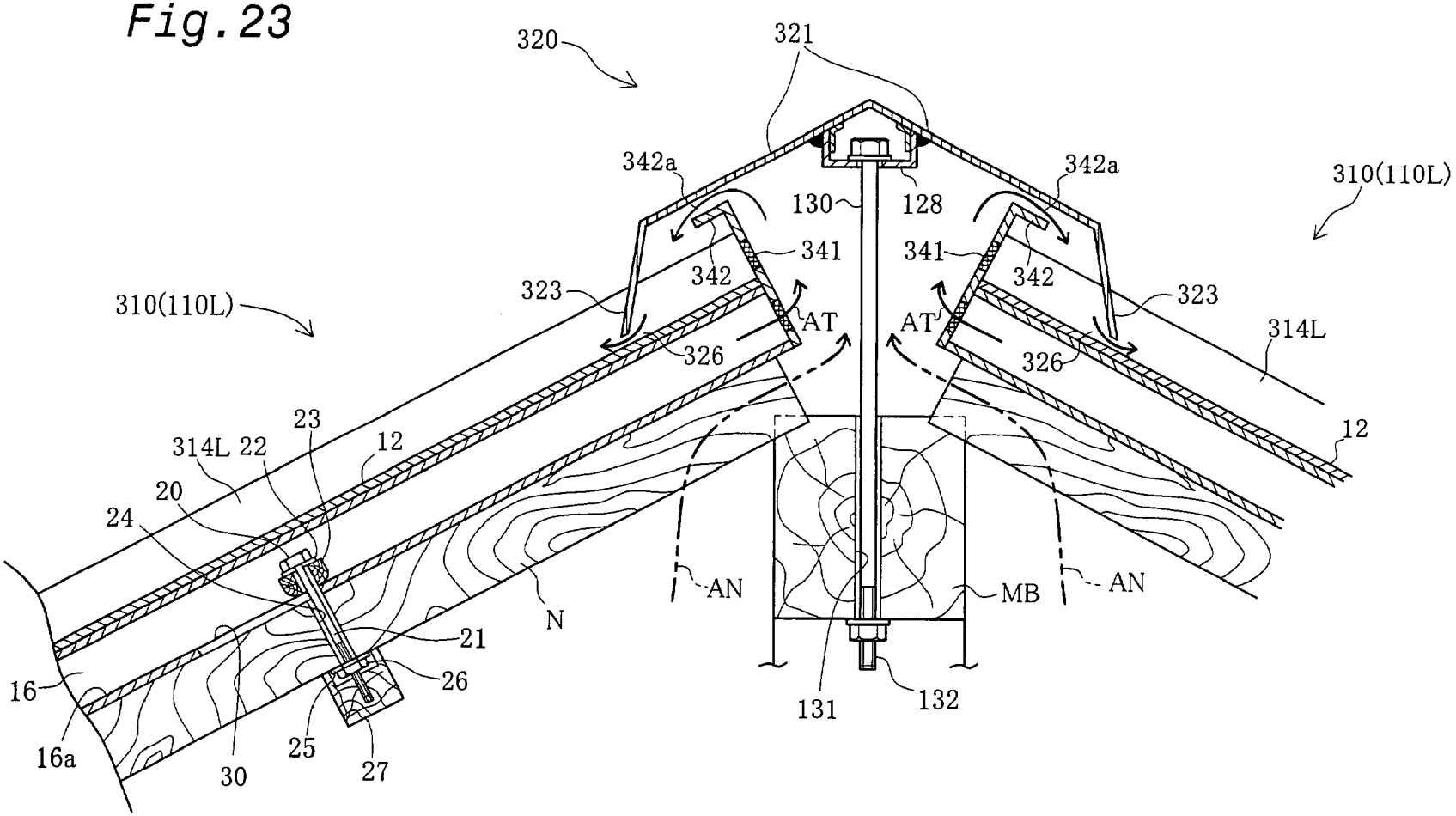
FIG. 23 shows fixation of the ridge capping 320 and the roof plate 310, as well as the positional relationship between the ridge capping 320 and the roof plate 310.

FIG. 22 is a partly broken perspective view schematically illustrating the ridge capping 320 of the second embodiment. FIG. 23 shows fixation of the ridge capping 320 and the roof plate 310, as well as the positional relationship between the ridge capping 320 and the roof plate 310. The ridge capping 320 has a similar structure to that of the ridge capping 120 shown in FIG. 7, and includes inclined ridge plates 321 arranged at a specific angle suitable for the pitch of the roof and gable end shielding plates 322 on both ends thereof. As shown in FIG. 23, in the ridge capping 320 of the second embodiment, the inclined end of each inclined ridge plate 321 is bent to form multiple skirt elements 323 with notches 324 therebetween. The notches 324 are formed in accordance with the pitch of the joint members 314L in the roofing assemblies 110L and 110R of the shingled roof. In the structure of the second embodiment, each of the skirt elements 323 parted by the notches is accordingly inserted into the space between the adjoining pair of the joint members 314L in the shingled roof. The protrusion length of the skirt element 323 is adjusted to form a gap 326 between its end and the upper face of the roof plate member 12 of the roof plate 310. Like the first embodiment, no mechanical binding, such as screwing or welding, is required for fixation of the roof plates 310 and the ridge capping 320.

In the shingled roof, each of the skirt elements 323 extended from the lower face of the ridge capping 320 is fitted in the recess defined by each adjoining pair of the joint members 314L, as shown in FIG. 23. In this state, the skirt element 323 blocks the recess via the gap 326, whereas the projection board 341 on the upper face of the roof plate member 12 blocks the recess via a gap 342*a* on the rear face side of the ridge capping 320. In the space defined by the lower face of the ridge capping 320 and the upper face of the roofing assemblies 110L and 110R, the skirt elements 323 on the lower face of the ridge capping 320 and the projection boards 341 are arranged to face each other in this sequence from the pole plate side to the ridge side to form horizontal arrays along the pitch of the roof.

The ridge capping 320 positioned in the above manner is propped up by the upper face of the multiple joint members 314L with the gaps 126 and 342*a*. Nuts 132 are screwed and clamped on the lower face of the ridgepole MB to strain and fix the ridge capping 320 to the ridgepole MB. This completes the procedure of roofing.

Like the first embodiment, the assembled ridge capping 320 and roofing assemblies 110L and 110R (more specifically, roof plates 310) enable easy detachment, recovery, and relocation (recycle), and ensure the advantages (1) through (3) discussed above.

In the structure of the second embodiment, the horizontal array of the skirt elements 323 on the lower face of the ridge capping 320 is located to face the horizontal array of the projection boards 341 along the pitch of the roof. This arrangement attains the effective rainfall measure to prevent the rainwater falling down on the roof from being flown up the roof plate members 12 toward the ridge against the pitch of the roof, as discussed in the first embodiment.

This arrangement also attains the effective rainfall measure against the rainwater falling down from the ridge capping 320 onto the roof assemblies 110L and 110R and the rainwater directly falling down on the roof assemblies 110L and 110R.

Like the first embodiment, the combined joint members 314R and 314L of the adjoining roof plates 310 as shown in FIGS. 17 and 20 almost completely keep the roof rafters N located below the roof plates 310 from the rainwater. The rainwater should run over the inner convex 316 fitted in the joint member 314L to enter the gap formed by the combined joint members 314R and 314L. Even in the case of heavy rain to make a layer of rainwater on the roof plate members 12 of the roof plates 310, it is practically impossible that the layer of rainwater continuously exceeds the projection height of the inner convex 316, since the roof plates 310 are inclined by a slope e, which is the pitch of the roof. Even if the rainwater exceeds the projection height of the inner convex 316 and enters the joint by any chance, the lower convex 317 connecting with the inner convex 316 functions as a gutter of the slope e to flow the rainwater down. In the structure of the second embodiment, the gutter of the slope e defined by the lower convex 317 has the greater depth than the projection height of the inner convex 316. Even if the rainwater exceeds the inner convex 316, the gutter having the greater depth than the projection height of the inner convex 316 exerts the effective drainage function and prevents the rainwater from entering the roof rafters.

In the structure of the second embodiment, the gaps 326 and 342*a* function as the air vents along the upper face of the roof plate members 12. This arrangement ensures the ventilation inside the building and under the roof, thus attaining the favorable residential environments.

Figure 24:
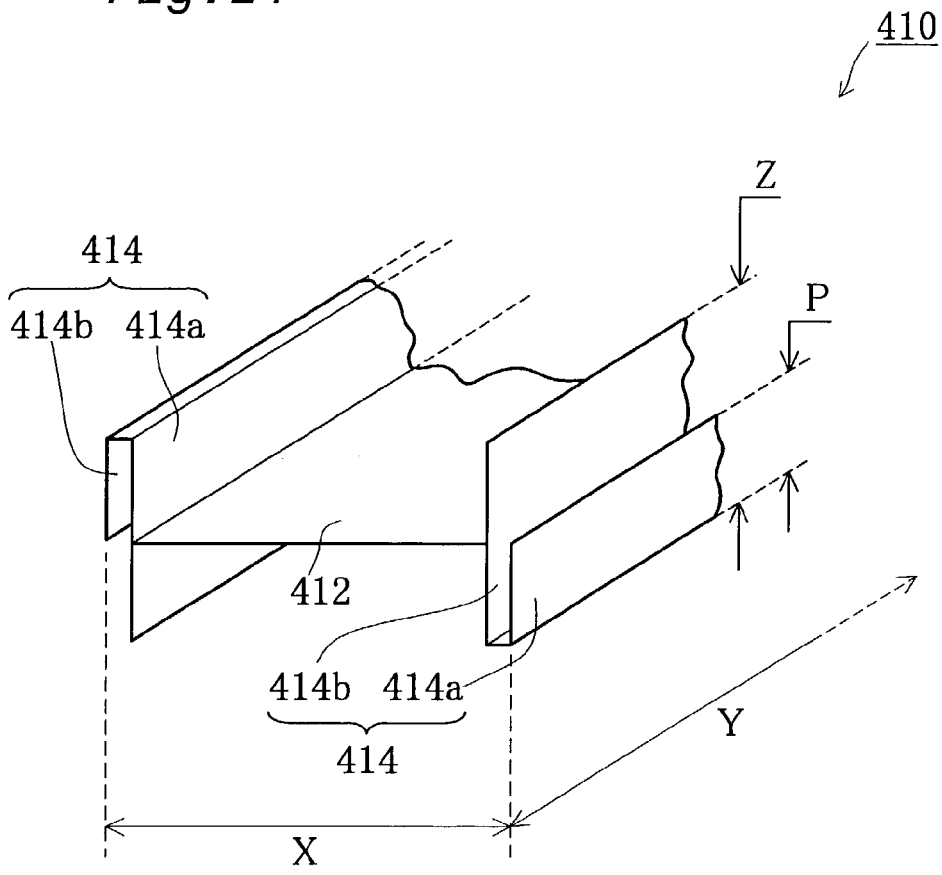
FIG. 24 is a perspective view illustrating a roof plate 410 in a third embodiment of the present invention.
Figure 25:
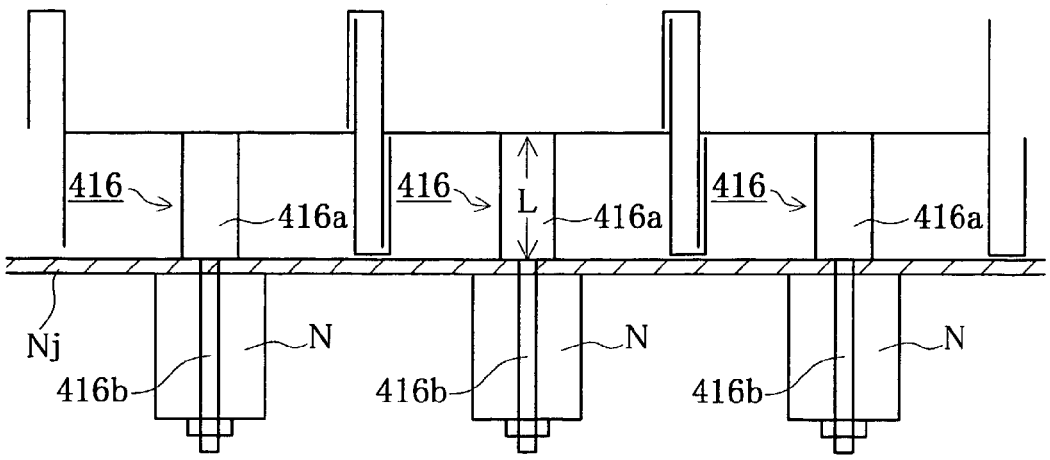
FIG. 25 is a front view showing joint of a large number of the roof plates 410 to shingle the roof.

Another roof plate is described below as still another embodiment of the present invention. FIG. 24 is a perspective view illustrating part of a roof plate 410 in a third embodiment. FIG. 25 is a front view showing joint of the roof plates 410. As illustrated, the roof plate 410 has a roof plate member 412, which is a long plate of a predetermined width, joint members 414 attached to the two longitudinal sides of the roof plate member 412, and a fixation member 416 projected from a preset width of a center portion of the roof plate member 412 and fixed to the sheathing roof board Nj and the roof rafter N. The joint member 414 has a substantially J-shaped cross section and includes a leg 414*a*, which is a broad, long plate having the same length as that of the roof plate member 412, and a fold 414*b*, which has substantially half the width of the leg 414*a*. A substantial center of the leg 414*a* is attached to each longitudinal side of the roof plate member 412 at practically right angles in such a manner that the fold 414*b* is located outside and the two joint members 414 are rotationally symmetrical about the roof plate member 412. The fixation member 416 has a rectangular solid main body 416*a* and a threaded rod 416*b* having one end embedded in the main body 416*a*. The threaded rod 416*b* is designed to have the projection length from the main body 416*a* to penetrate the sheathing roof board Nj and the roof rafter N.

A width X of the roof plate 410 having the above structure is set equal to the interval of the roof rafters N as shown in FIG. 25, and a length Y of the roof plate 410 is determined according to the length of the roof to be shingled. The roof plates 410 of such dimensions are manufactured, processed, and are brought into the field for roofing. It is preferable that a height Z of the leg 414*a* of the joint member 414 (see FIG. 24) is shorter than the width X of the roof plate 410. In this embodiment, X is 900 mm and Y is 4000 mm. The height Z of the leg 414*a* is 75 mm, and a width P of the fold 414*b* is 75 mm. The joint of the leg 414*a* with the fold 414*b* should have a dimension that prevents the joint from biting into the sheathing roof board Nj and ranges from 15 mm to 45 mm. In this embodiment, the dimension of the joint is 16 mm.

The roof plate member 412 and the joint member 414 are made of metal titanium that is light in weight and has excellent durability, and are firmly joined with each other by seamless welding. The fixation member 416 is made of a plastic (preferably a composite plastic containing glass fibers or carbon fibers) having the better heat insulating and vibration isolating effects, compared with the roof plate member 412. The fixation members 416 may be attached to the roof plate member 412 at preset intervals, at intervals of about 2000 mm in this embodiment, along its longitudinal axis, by an appropriate technique, such as adhesion. At least a base portion of the main body 416*a* in the fixation member 416 may be made of the same metal material as that of the roof plate member 412. This allows application of any simple and secure fixing technique, such as welding, for fixation of the fixation member 416.

As shown in FIG. 25, the leg 414*a* and the fold 414*b* of one joint member 414 is fitted in and joined with the leg 414*a* and the fold 414*b* of an adjoining joint member 414. A nut M is screwed to each threaded rod 416*b* of the fixation member 416 that penetrates the sheathing roof board Nj and the roof rafter N. The roof plates 410 are laid to shingle the roof. No mechanical binding, such as screwing or welding, is required for joint of the adjoining roof plates 410. This arrangement ensures roofing by the simple procedure. The arrangement also ensures easy detachment, recovery, relocation (recycle), and maintenance of the roof plates 410. The joint effectively absorbs a shape change of the roof plate 410 over time or with a variation in thermal expansion, thus preventing accumulation of useless stresses and enhancing the durability. An air layer corresponding to a height L of the main body 416*a* of the fixation member 416 is formed between the sheathing roof board Nj and the roof plate member 412. This air layer effectively exerts the sound proof function against the pattering sound of raindrops and the heat insulating function against the temperature change of the roof plate members 412 with the varying environment.

Figure 26:
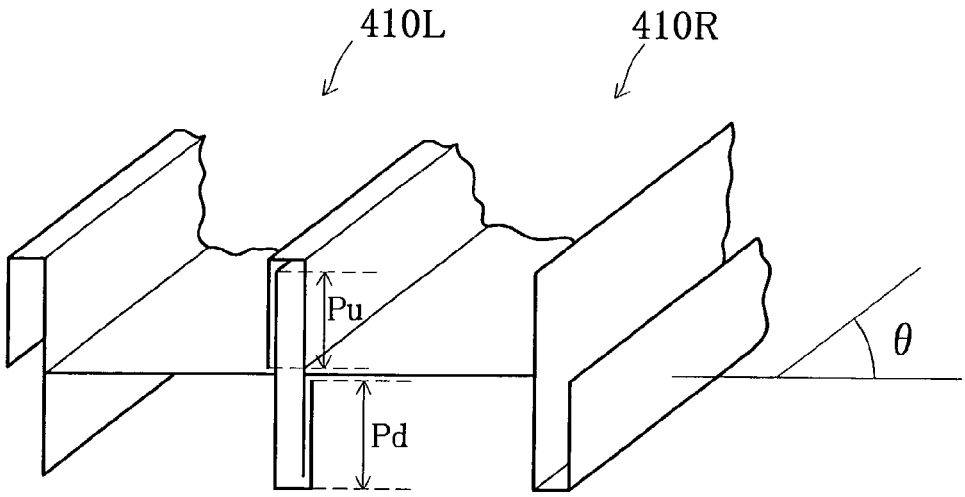
FIG. 26 shows waterproof effect of the roof plate 410.

FIG. 26 shows the waterproof effect of the roof plate 410 applied for the roof. As illustrated, there is a little gap between a left roof plate 410L and a right roof plate 410R, since they are not mechanically bonded to each other but are fitted in each other. The structure, however, allows practically no penetration of rainwater into the gap, and almost completely keeps the sheathing roof board Nj located below the roof plate 410 from rainwater. The rainwater should go up to a height Pu, which is the width P of the fold 414*b* of the left roof plate 410L, to flow into the gap. Even in the case of heavy rain to make a layer of rainwater on the roof plate member 412 of the roof plate 410L, it is practically impossible that the layer of rainwater exceeds the height Pu, since the roof plate 410L is inclined by a slope θ, which is the pitch of the roof. Even if the rainwater exceeds the height Pu and enters the joint by any chance, the fold of the right roof plate 410R functions as a gutter of a height Pd and the slope θ to flow the rainwater down.

Figure 27:
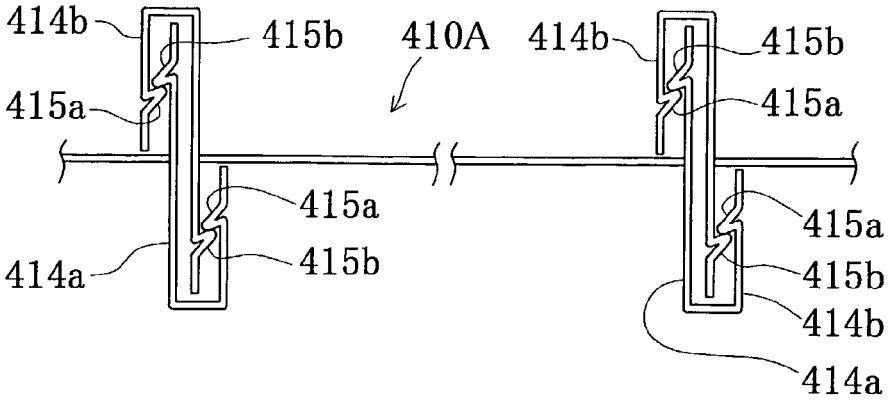
FIG. 27 shows a roof plate 410A in one modified example of the third embodiment.

FIG. 27 shows a roof plate 410A in one modified example of the third embodiment. In this modified example, the fold 414*b* and the leg 414*a* respectively have engagement pieces 415*a* and 415*b*. These engagement pieces are formed by bending the plates of the fold 414*b* and the leg 414*a*, and function to prevent the leg 414*a* from being slipped off the fold 414*b* after the leg 414*a* and the fold 414*b* of the adjoining joint members 414 are fitted in and joined with each other. This structure accordingly prevents undesirable strip of the roof plate 410A. For detachment of the roof plate 410A from the roof, the fold 414*b* of the roof plate member 410A is warped to release the engagement pieces 415*a* and 415*b* from each other.

The above embodiments and their modifications are to be considered in all aspects as illustrative and not restrictive. There may be many modifications, changes, and alterations without departing from the scope or spirit of the main characteristics of the present invention.

For example, the fixation hole 30 of the first embodiment is not limited to the shape shown in FIG. 9, but may have any appropriate shape. The wide slot section 32 may have a quasi-triangular shape.

The joint member for connecting the adjoining roof plates 10 is not restricted to the structure of preventing penetration of rainwater like the joint member 14.

The first embodiment uses the roof plate 10 with the joint members 14, which form the convex. A conventional corrugated slate having trapezoidal concaves and convexes may be used in place of the roof plates 10 of the first embodiment.

In the second embodiment, the joint member 314L, the inner convex 316, and the lower convex 317 are rectangular convex. They may alternatively be triangular convex or trapezoidal convex.

INDUSTRIAL APPLICABILITY

The structure of the invention is suitably applied for the gabled roof having slopes from the peak of the roof or the ridge to the pole plates on both sides. The arrangement ensures the effective rainfall measure of the roof plates and simplifies attachment and detachment.

What is claimed is:

1. A roof shingled by laying roof plates with a certain pitch of roof from a ridge at a roof peak to pole plates on both sides, said roof comprising:

multiple convexes that are protruded upward from each of said roof plates and are arranged along a roof width, each of the convexes having a predetermined length from the ridge along the pitch of roof;

a ridge capping that is located at the ridge and covers said roof plates on both sides of said roof and the multiple convexes across the roof width to determine a ridge appearance of said roof; and a capping fixation member that fixes said ridge capping to a ridgepole of said roof, such that said ridge capping covers said roof plates and the multiple convexes, wherein said ridge capping has an inter-convex projection plate, which is protruded from a lower face of said ridge capping to be fitted in a recess between each adjoining pair of the convexes, said roof plate having a roof plate-side projection board, which is protruded from an upper face of said roof plate and is located above the inter-convex projection plate of said ridge capping along the pitch of roof to face the inter-convex projection plate, the inter-convex projection plate and the roof plate-side projection board is formed over the entire length from one convex to the other convex of the adjoining pair of the convexes, and the roof plate-side projection board being inclined to have a falling edge, so as to cause rainwater running over the roof plate-side projection board to be flown down along the inclination of the roof plate-side projection board.

2. A roof in accordance with claim 1, wherein said ridge capping has a plurality of the inter-convex projection plates along the pitch of roof, and the roof plate-side projection board of said roof plate is located between an adjoining pair of the inter-convex projection plates along the pitch of roof.

3. A roof in accordance with claim 1, wherein said capping fixation member strains said ridge capping toward the ridge pole for fixation.

4. A roof in accordance with claim 1, wherein the inter-convex projection plate has a lower air vent on a lower projection end thereof to allow ventilation of the air along the upper face of said roof plate, and the roof plate-side projection board has an upper air vent on an upper projection end thereof to allow ventilation of the air along the lower face of said ridge capping.

5. A roof in accordance with claim 1, wherein the convex has a length identical with a length of said roof plate.

6. A roof in accordance with claim 1, wherein said roof plate has a net inside the convex to prevent invasion of small animals like rats and insects.

7. A roof in accordance with claim 1, wherein said roof plate integrally comprises: a roof plate member that is located above a roof frame member disposed between the ridgepole and the pole plates along the pitch of root a hollow support member that props up said roof plate member apart from said roof flame member; and the convex.

8. A roof in accordance with claim 7, wherein said roof plate member is a board of a predetermined width and has joint members on both sides across its width to make each adjoining pair of said roof plate members joined with each other, so that a plurality of said roof plate members are laid longitudinally to shingle said roof, and said joint member has a leg, which is protruded from an end of said roof plate member and props up said roof plate member at the and apart from said roof frame member, the leg having a height substantially identical with a height of said support member.

9. A roof in accordance with claim 8, wherein said roof plate has a net in a space between said roof frame member and said roof plate member propped up by the leg and said support member to prevent invasion of small animals like rats and insects.

10. A roof plate, a plurality of said roof plates being joined with and fixed to one another to define a roof appearance, said roof plate comprising:

a roof plate member that is a long board of a predetermined width;

two joint members, wherein the two joint members have a substantially J-shaped cross section and include a leg, which is a broad, long plate having an identical length with a length of said roof plate member, and a fold, which has substantially half a width of the leg, the leg and the fold being joined with each other along their longitudinal sides, a substantial center of the leg being attached to each longitudinal side of said roof plate member at practically right angles in such a manner that the fold is located outside of said roof plate member and said two joint members are rotationally symmetrical about said roof plate member; and a fixation member that is attached to said roof plate member to prop up said roof plate member apart from a roof frame member and fix said roof plate member to said roof frame member.

11. A roof plate in accordance with claim 10, wherein said fixation member is located on a center of said roof plate member.

12. A roof plate in accordance with claim 10, wherein said roof plate member and said joint member are composed of a metal.

13. A roof plate in accordance with claim 10, wherein said joint member is welded to said roof plate member.

14. A roof plate in accordance with claim 10, wherein said fixation member is composed of a material having at least either of better heat insulating effect and better vibration isolating effect, compared with said roof plate member.

15. A roof plate in accordance with claim 10, wherein said fixation member comprises a hollow support member that is integrated with said roof plate member to prop up said roof plate member apart from said roof frame member, said support member having a fixation hole, which is formed in a bottom face thereof that is in contact with said roof frame member, and receives a fixing element protruded from said roof frame member, said fixation hole having a positioning section that positions said fixing element, and a broader section that is wider than said fixing element, where the positioning section is located above the broader section along the pitch of roof.

16. A roof plate in accordance with claim 15, wherein said roof plate member is a board of a predetermined width and has joint members on both sides across its width to make each adjoining pair of said roof plate members joined with each other, so that a plurality of said roof plate members are laid longitudinally to shingle said roof, and said joint member has a leg, which is protruded from and end of said roof plate member and props up said roof plate member at the end apart from said roof frame member, the leg having a height substantially identical with a height of said support member.

17. A roof plate in accordance with claim 15, wherein said fixing element for fixing said roof plate comprises:

a washer that is located above said roof frame member and has an inclined or spherical surface on one side thereof close to said roof frame member;

a shaft member that penetrates said washer and said roof frame member from a top face side of said washer; and a straining member that strains said shaft member from a bottom face side of said roof frame member for fixation.

18. A roof plate in accordance with claim 17, wherein said shaft member is a bolt and said straining member is a nut.

19. A roof plate in accordance with claim 18, wherein said nut and said bolt end are covered with a cap nut.

20. A roof plate a plurality of said roof plates being horizontally laid on and fixed to a roof frame member to define a roof appearance, said roof plate comprising:

a roof plate member that is a long board of a predetermined width;

a convex body that is attached to and protruded upward from one side of said roof plate member along a pitch of roof;

a joint member that is attached to the other side of said roof plate member along the pitch of roof to be combined with said convex body of an adjoining roof plate member; and a fixation member that is attached to said roof plate member to prop up said roof plate member apart from said roof frame member and fix said roof plate member to said roof frame member, said joint member comprising:

an inner convex that is protruded upward from said roof plate member to be inserted in said convex body of said adjoining roof plate member; and a lower convex that connects with the inner convex and is protruded downward from said roof plate member, the lower convex having a rising side end, which defines a convex shape on the other side of said roof plate and has an extension toward a lower face of said adjoining roof plate member, and the lower convex of said joint member having a greater projection height than a projection height of said convex body across said roof plate member.

21. A roof plate in accordance with claim 20, wherein said roof plate member, said convex body, and said joint member are made of a metal, said convex body is formed by bending the one side of said roof plate member, and the inner convex and the lower convex of said joint member are formed by bending the other side of said roof plate member.

22. A roof plate in accordance with claim 20, wherein the inner convex has a top face that is in contact with a bottom face of said convex body of said adjoining roof plate member.

23. A roof plate in accordance with claim 20, wherein the lower convex is protruded downward from said roof plate member to a height substantially equal to a height of said fixation member from a lower face of said roof plate member.

24. A roof plate in accordance with claim 20, wherein said fixation member is located on a center of said roof plate member.

25. A roof plate in accordance with claim 20, wherein the lower convex has a flange on an upper edge of the rising side end, which comes into contact with a lower face of said roof plate member.

26. A roof plate in accordance with claim 25, wherein said convex body has a falling side end that is extended toward an upper face of an adjoining roof plate member to form a flange on a lower edge thereof, which comes into contact with the upper face of said adjoining roof plate member.

27. A roof plate in accordance claim 20, wherein said fixation member comprises a hollow support member that is integrated with said roof plate member to prop up said roof plate member apart from said roof frame member, said support member having a fixation hole, which is formed in a bottom face thereof that is in contact with said roof frame member, and receives a fixing element protruded from said roof frame member, said fixation hole having a positioning section that positions said fixing element, and a broader section that is wider than said fixing element, where the positioning section is located above the broader section along the pitch of roof.

* * * * *

UNITED STATES PATENT AND TRADEMARK OFFICE

CERTIFICATE OF CORRECTION

PATENT NO. : 6,955,012 B2
DATED : October 18, 2005
INVENTOR(S) : Motoyuki Suzuki It is certified that error appears in the above-identified patent and that said Letters Patent is hereby corrected as shown below:

Title page,
Item [73], Assignee, change "Muzukawa" to -- Mizukawa --.

Column 26,
Line 27, delete "20" after "advantages".

Column 35,
Line 31, change "pitch of root" to -- pitch of roof --.
Line 33, change "root flame" to -- roof flame --.
Line 42, change "the and apart" to -- the end apart --.

Column 36,
Line 36, change "from and" to -- from an --.

Column 38,
Line 17, add -- with -- after "accordance".

Signed and Sealed this

Twenty-fifth Day of April, 2006

JON W. DUDAS
*Director of the United States Patent and Trademark Office*